US009248558B1

(12) United States Patent
Burkhardt

(10) Patent No.: US 9,248,558 B1
(45) Date of Patent: Feb. 2, 2016

(54) DEVICE AND METHOD FOR MANIPULATING A MAGNETIC OBJECT

(76) Inventor: George Wayne Burkhardt, San Antonio, TX (US)

( * ) Notice: Subject to any disclaimer, the term of this patent is extended or adjusted under 35 U.S.C. 154(b) by 528 days.

(21) Appl. No.: 13/507,218

(22) Filed: Jun. 13, 2012

Related U.S. Application Data

(60) Provisional application No. 61/571,104, filed on Jun. 21, 2011.

(51) Int. Cl.
*B25B 23/12* (2006.01)
*B25B 13/02* (2006.01)

(52) U.S. Cl.
CPC ..... *B25B 23/12* (2013.01); *B25B 13/02* (2013.01)

(58) Field of Classification Search
CPC ..... B25B 13/02
See application file for complete search history.

(56) References Cited

U.S. PATENT DOCUMENTS

| | | | | | |
|---|---|---|---|---|---|
| 2,758,494 | A | * | 8/1956 | Jenkins | 81/438 |
| 3,126,774 | A | * | 3/1964 | Carr et al. | 81/125 |
| 3,731,722 | A | * | 5/1973 | Carr | 81/451 |
| 3,884,282 | A | * | 5/1975 | Dobrosielski | 81/439 |
| 4,145,939 | A | | 3/1979 | Garrison | |
| 4,794,827 | A | | 1/1989 | Poling | |
| 4,862,776 | A | | 9/1989 | Poling | |
| 5,065,649 | A | * | 11/1991 | Evers et al. | 81/458 |
| 5,199,331 | A | | 4/1993 | Tsukamoto | |
| 5,499,557 | A | | 3/1996 | Fry | |
| 5,544,555 | A | | 8/1996 | Corley | |
| 5,572,913 | A | | 11/1996 | Nasiell | |
| 5,603,248 | A | * | 2/1997 | Eggert et al. | 81/438 |
| 5,642,647 | A | | 7/1997 | Peruski | |
| 5,916,340 | A | | 6/1999 | Forsyth | |
| 6,006,630 | A | | 12/1999 | Vasichek et al. | |
| 6,038,946 | A | * | 3/2000 | Jackson et al. | 81/177.2 |
| 6,260,451 | B1 | | 7/2001 | Mirabito | |
| 6,810,774 | B2 | | 11/2004 | Hsien | |
| 6,955,105 | B2 | | 10/2005 | Chen | |
| 7,124,665 | B1 | * | 10/2006 | Chen | 81/451 |
| 7,591,207 | B1 | * | 9/2009 | Burkhardt | 81/125 |
| 2005/0098002 | A1 | * | 5/2005 | Holland-Letz | 81/451 |
| 2008/0047075 | A1 | * | 2/2008 | Chang | 7/170 |

FOREIGN PATENT DOCUMENTS

| | | | | |
|---|---|---|---|---|
| JP | 56003185 | A | * | 1/1981 |
| WO | WO 0149459 | A1 | * | 7/2001 |

* cited by examiner

*Primary Examiner* — Mohamad Musleh

(57) ABSTRACT

A novel, simple, inexpensive and universal device and method for manipulating a magnetic object with at least a portion thereof having one of a substantially prismatic cavity and a substantially prismatic shape, each with side surfaces and an end surface such as a fastener, bolt, nut, plug, screw, and the like is disclosed. One embodiment of the device includes a head assembly having a magnetic field. The head assembly includes a body and a magnetic pole piece. The body serves to support the magnetic pole piece and the magnetic pole piece is configured to contact no more than two side surfaces of the magnetic object. The magnetic pole piece is also constructed and arranged to concentrate and shape the magnetic field into the magnetic object. The head assembly is further configured to be spatially open opposite from the magnetic pole piece so as to receive and contact the magnetic object.

8 Claims, 25 Drawing Sheets

DEVICE AND METHOD FOR MANIPULATING A MAGNETIC OBJECT

CROSS-REFERENCE TO RELATED APPLICATIONS

This application claims the benefit of Provisional U.S. Patent Application Ser. No. 61/571,104, filed Jun. 21, 2011 by the present inventor.

FEDERALLY SPONSORED RESEARCH

None.

FIELD

This application relates to remotely manipulating a magnetic object with at least a portion thereof having either a substantially prismatic shape or a substantially prismatic cavity and more specifically to a device and method for remote placement, installation, and/or removal of a magnetic object such as fastener, bolt, nut, plug, screw, and the like having the aforementioned geometry.

BACKGROUND

In my U.S. Pat. No. 7,591,207 entitled, Device And Method For Remotely Manipulating A Magnetic Object With At Least A Portion Thereof Having A Substantially Prismatic Shape, a tool was disclosed that has achieved elevated acceptance in the marketplace. Through further development of the tool, I have discovered that the utility provided by the tool can be extended into other useful tools. Accordingly, U.S. Pat. No. 7,591,207 is incorporated herein by reference.

The ever increasing design constraints placed on the development of modern machinery has resulted in removable objects typically used for securing of parts or passageway closures to be disposed in limited access areas and require removal/installation from a more desirable remote location. These generally magnetic objects are usually threaded and have at least a portion thereof exhibiting a substantially prismatic shape. As used herein, a "prismatic shape" can be either a solid whose ends are polygonal and equal in size and shape and whose sides are parallelograms or a substantially prismatic cavity for receiving such shape or object. Typically, the ends of these magnetic objects have prismatic shapes, at least in part, and are hexagonal or cubic while others have corresponding prismatic cavities or sockets.

Tools, such as various wrenches, ratchets including various sockets and extension bars, allen wrenches etc., exist for initial installation (starting or insertion of an object onto/into a counterpart and if it is threaded, screwing or threading onto/into a threaded counterpart), final removal (removal of a pre-loosened object from its counterpart and if it is threaded, unscrewing or unthreading from its threaded counterpart), and/or placement of these objects in usually remote limited access areas.

However, these tools are typically either expensive; fit only one size object; not articulated; do not properly engage objects with their counterparts in adverse orientations; and are bulky, therefore, they are not conducive to placement, initial installation, and/or final removal of the objects. In addition, the installation of most threaded fasteners, including bolts and nuts, usually require that a washer, spacer, or the like be installed, however conventional wrenches and tools do not have the capability to adequately hold and maintain alignment of both a fastener and washer for remote installation at unfavorable orientations in limited access locations.

With respect to removing oil drain plugs in engines, transmissions, differentials, etc., the drain plug is typically loosened with a conventional wrench and is then further unscrewed and removed by hand. This results in the probability of hot oil getting on hands, arms, and/or floor and the probability that the drain plug will be dropped in the oil drain container. This drain plug removal process, which is the norm, poses additional safety hazards when draining hot oil from a hot engine because the hot oil can burn the skin and inadvertently dropping the drain plug in the oil container can splash hot oil into the eyes or face.

In addition, the drain plug removal process is further compounded on cars and other vehicles that are low to the ground which results in drain plugs that are not easily accessible. The requirement for removal of the drain plug is a device that easily engages with the drain plug and places the hand and arm at a remote distance from the drain plug, thus, preventing hot oil from contacting the body and a device that facilitates removal of the drain plug in areas of limited access.

To facilitate the manipulation of magnetic objects either remotely and/or in areas of limited access, numerous prior art tools have been developed but they all heretofore known suffer from a number of deficiencies and drawbacks. In general, these tools fit into 2 categories, namely (1) those that position, install, and remove fasteners, bolts, nuts, screws and the like and (2) those that position, install, and remove plugs, such as oil drain plugs. Category 1 is further sub-divided into wrenches with fixed jaws, socket wrenches, and other miscellaneous tools.

Examples of prior art wrenches with fixed jaws are U.S. Pat. No. 6,955,105 issued Oct. 18, 2005 to Chuan-Chen Chen and U.S. Pat. No. 6,810,774 issued Nov. 2, 2004 to Chih-Ching Hsien. These wrenches have a permanent magnet integrated in a jaw or adjacent to a jaw for holding the magnetic object within the jaws of the wrench. The disadvantages of this type of wrench are that it (1) cannot fit into areas of limited access; (2) cannot articulate because the handle is rigid; (3) fits only one size of fastener on each end of the wrench; (4) cannot secure and maintain alignment of both a nut and washer or washer to the head of a bolt; (5) is relatively expensive because a set of wrenches are usually required; and (6) is not conducive to initial installation of a magnetic object.

Examples of prior art socket wrenches are U.S. Pat. No. 6,006,630 issued Dec. 28, 1999 to Richard A. Vasichek, Robert J. Vasichek, Gregory J. Grote, and Paul D. Sigaty; U.S. Pat. No. 5,916,340 issued Jun. 29, 1999 to Don Forsyth; and U.S. Pat. No. 5,544,555 issued Aug. 13, 1996 to Ronald E. Corley. These wrenches have a permanent magnet(s) integrated within the cavity of the socket for holding a magnetic fastener. The disadvantages of this type of wrench are that (1) it fits only one size of object per socket; (2) it is relatively expensive because a set of sockets are usually required; (3) it cannot secure and maintain alignment of both a nut and washer or washer to the head of a bolt; (4) articulation is possible with the use of universal joints and extensions but is limited, thereby reducing the usefulness in restricted areas; and (5) is not conducive to initial installation of a magnetic object.

Another example of a prior art socket wrench appears in U.S. Pat. No. 5,572,913 issued Nov. 12, 1996 to Gustav Nasiell. This wrench includes a socket body having spring biased jaws and a flexible arm with an internal flexible shaft. The flexible arm can be configured to bias the flexible shaft into the required curve appropriate for performing placement, initial installation, and/or final removal of fasteners, spark plugs, and the like in limited access areas with the jaws being able to grasp varying sizes of heads. The disadvantages of this type wrench or tool are that (1) it has a number of moving parts and therefore, it is relatively expensive to manufacture; (2) the jaws have a limited head grasping range and therefore, cannot adapt to a wide range of fasteners and the like; (3) as the jaws expand to accommodate larger fastener heads, the jaw faces become non-parallel to the fastener head sides and therefore, have the tendency to not grasp the fastener head securely; (4) the flexible arm cannot be removed from the tool and used only with the flexible shaft; (5) it has deficiencies with respect to oil drain plug removal in that the many moving parts and cavities would entrap oil and be hard to clean; and (6) since the flexible arm is relative rigid, the drain plug will not automatically fall out of the oil stream via the force of gravity, resulting in splashing of the oil.

A prior art example of a miscellaneous tool appears in U.S. Pat. No. 5,642,647 issued Jul. 1, 1997 to Robert Peruski. This tool includes a coiled wire loop, a corresponding loop shaped backing plate, and a handle. The wire loop and loop shaped backing plate form a pocket for receiving and holding the head of an object. The disadvantages of this tool are that (1) it cannot secure and maintain alignment of both a nut and washer or washer to the head of a bolt; cannot articulate because the handle is rigid; (2) it is relatively bulky and therefore, cannot be used in limited access areas; and (3) it is not conducive to initial installation and final removal of a magnetic object.

Examples of tools applicable to category 2, above, are U.S. Pat. No. 4,794,827 issued Jan. 3, 1989 to Denzil Poling, U.S. Pat. No. 4,145,939 issued Mar. 27, 1979 to Ward S. Garrison, and U.S. Pat. No. 5,199,331 issued Apr. 6, 1993 to Kazuichi Tsukamoto. In general, these tools include a rotatable socket with adjustable jaws to accommodate and secure various drain plug head sizes and a handle for rotation of the socket and plug. In addition, these tools generally have a permanent magnet attached to the inside of the socket to retain the drain plug. U.S. Pat. Nos. 4,794,827 and 4,145,939 further includes a line for tethering the socket to an anchor to prevent the socket with attached drain plug from falling a distance greater than thy line length. U.S. Pat. No. 5,199,331 further includes a concave shield to catch and deflect draining oil away from the hand of the user.

The main disadvantage of the above tools in category 2, is that they do not provide for remote rotation and removal of the drain plug to ensure that hot oil does not contact the user's hand and/or arm. While U.S. Pat. No. 5,199,331 includes a concave shield to catch the initial oil, it cannot be ensured that oil will not contact the user because (1) if the user does not move the tool out of the oil stream quickly, the concave shield can overflow onto the user and (2) if the tool is removed quickly, oil can splash out of the concave shield and onto the user. In addition, the tethered tools utilize a permanent magnet to attach the tether to a convenient anchor, usually the oil pan, which in many cases is not made from magnetic material. Furthermore, the tools have a single purpose use and cannot be readily used for other applications.

Another example of a tool applicable to category 2, above appears in U.S. Pat. No. 5,499,557 issued Mar. 19, 1996 to James K. Fry. This tool includes a removable socket at the head of the tool, a rotatable handle disposed opposite from the head, and mechanical linkage connecting the socket with the handle, whereby, rotation of the handle is translated to rotation of the socket. While the tool provides for remote rotation and removal of the drain plug, it has other disadvantages, namely: (1) the tool is mechanically involved, hence, expensive, (2) it requires a set of special sockets to accommodate varying size drain plugs, further increasing the cost, (3) the tool is hard to clean due to many crevices to entrap oil that runs over the tool, and (4) the tool has a single purpose use and cannot be readily used for other applications.

Additional examples of tools applicable to category 2, above are U.S. Pat. No. 4,862,776 issued Sep. 5, 1989 to Denzil Poling and U.S. Pat. No. 6,260,451 issued Jul. 17, 2001 to Frank D. Mirabito. U.S. Pat. No. 4,862,776 includes a clip for rotatably engaging and holding a drain plug head, a flexible shaft connected to the clip, and a handle connected to the other end of the shaft for manually rotating the shaft and clip for the purpose of unscrewing an attached drain plug. The clip includes openable spring biased jaws to secure the drain plug head. While the tool provides for remote rotation and removal of the drain plug, it has other disadvantages, namely: (1) the drain plug has to be unscrewed far enough to permit the jaws to contact the back side face of the drain plug head which could result in leakage of oil, (2) if the shaft is flexed during plug removal, as would be the usual case, the jaws tend to rotate off the drain plug center axis causing undue flexing of the shaft and unstable rotation of the tool, (3) oil will be hard to clean off of the clip because of its involved geometry, and (4) the tool has a single purpose use and cannot be readily used for other applications.

U.S. Pat. No. 6,260,451 includes a tool head, a flexible shaft connected to the tool head, and a handle connected to the other end of the shaft for manually rotating the shaft and tool head for initial installation and final removal of threaded drain plugs. The tool head includes cavities for engaging with drain plug heads incorporating protrusions. The disadvantage of this tool is that it works only on drain plugs that have heads with protrusions, hence, it has a very limited application base.

While the aforementioned tools provide for manipulating objects with at least a portion thereof having a substantially prismatic shape, such as fasteners, bolts, nuts, plugs, screws, and the like, they all heretofore known suffer from deficiencies and drawbacks. There remains a need in the art for an inexpensive, universal, easy to clean, and simple-to-use device that permits remote placement, initial installation, and/or final removal of these objects (1) in distant areas of limited access, (2) by self adapting to a wide range of object heads, (3) simultaneously with washers, spacers, and the like while maintaining pre-placed alignment with the object, (4) in off axis locations were device articulation is required, (5) with a tool having no moving parts, (6) in particular, drain plugs, without hot oil or other liquid being drained contacting hands and/or arms, and (7) while maintaining adequate engagement with the objects when at adverse orientations.

The invention disclosed in U.S. Pat. No. 7,591,207, issued Sep. 22, 2009, to George Wayne Burkhardt has all of the aforementioned benefits and features, however, further testing and research has resulted in improvements, alterations and/or additional embodiments that further enhance the benefits and features of the invention. These enhanced parameters are brought forth in the following description of this invention.

SUMMARY

A novel, simple, inexpensive, and universal device and method for manipulating a magnetic object with at least a portion thereof having one of a substantially prismatic cavity and a substantially prismatic shape, each with side surfaces and an end surface such as a fastener, bolt, nut, plug, screw, and the like is disclosed. One embodiment of the device includes a head assembly having a magnetic field. The head assembly includes a body and a magnetic pole piece. The body serves to support the magnetic pole piece and the magnetic pole piece is configured to contact no more than two side surfaces of the magnetic object. The magnetic pole piece also is constructed and arranged to concentrate and shape the magnetic field into the magnetic object. The head assembly is further configured to be spatially open opposite from the magnetic pole piece so as to receive and contact the magnetic object. Whereby, when one of the substantially prismatic cavity and the substantially prismatic shape of the magnetic object is placed in proximity to the head assembly, the magnetic field draws no more than two side surfaces of the magnetic object into contact with the magnetic pole piece, the device thereby engaging the magnetic object and allowing for its manipulation.

Accordingly, all of the disclosed embodiments may have one or more of the following advantages which are:

(a) to provide a device that will permit remote placement, initial installation and/or final removal of magnetic objects, with at least a portion thereof having a substantially prismatic shape or a substantially prismatic cavity, such as fasteners, bolts, nuts, plugs, screws and the like in limited access locations;

(b) to provide a device that will engage with all sizes of magnetic objects with a given prismatic shape or cavity;

(c) to provide a device that will permit remote placement, initial installation and/or final removal of both a magnetic object, with at least a portion thereof having a substantially prismatic shape, and a washer, spacer, or the like simultaneously;

(d) to provide a device that will permit remote placement, initial installation and/or final removal of magnetic objects, with at least a portion thereof having a substantially prismatic shape or cavity, in off axis locations were extreme device articulation is required;

(e) to provide a device without moving parts;

(f) to provide a device that will permit remote placement, initial installation and/or final removal of magnetic objects, with at least a portion thereof having a substantially prismatic shape or cavity, in adverse locations were pre-adjusted flexible shaft articulation is required to remain fixed;

(g) to provide a device that will permit the remote removal of drain plugs while limiting the possibility of hot oil or other liquid being drained from contacting hands and/or arms;

(h) to provide a method for placement, initial installation and/or final removal of magnetic objects, with at least a portion thereof having a substantially prismatic shape or cavity, such as fasteners, bolts, nuts, plugs, screws, and the like in locations of limited access; and (i) to provide a device that is inexpensive, universal, easy to clean, and simple to use. Still further advantages should become apparent from a consideration of the ensuing description and the drawings.

BRIEF DESCRIPTION OF DRAWINGS

A better understanding of the embodiments may be had by reference to the drawing figures wherein.

DETAILED DESCRIPTION OF THE EMBODIMENTS

This application relates to remotely manipulating a magnetic object with at least a portion of the magnetic object having a substantially prismatic shape or cavity, and more specifically to a device and method for remote placement, initial installation, and/or final removal of magnetic objects such as fasteners, bolts, nuts, plugs, screws, and the like in limited access locations having the aforementioned geometry.

First Embodiment

FIG. 1, FIG. 1A, FIG. 2, FIG. 2A, and FIG. 3

Figure 1:
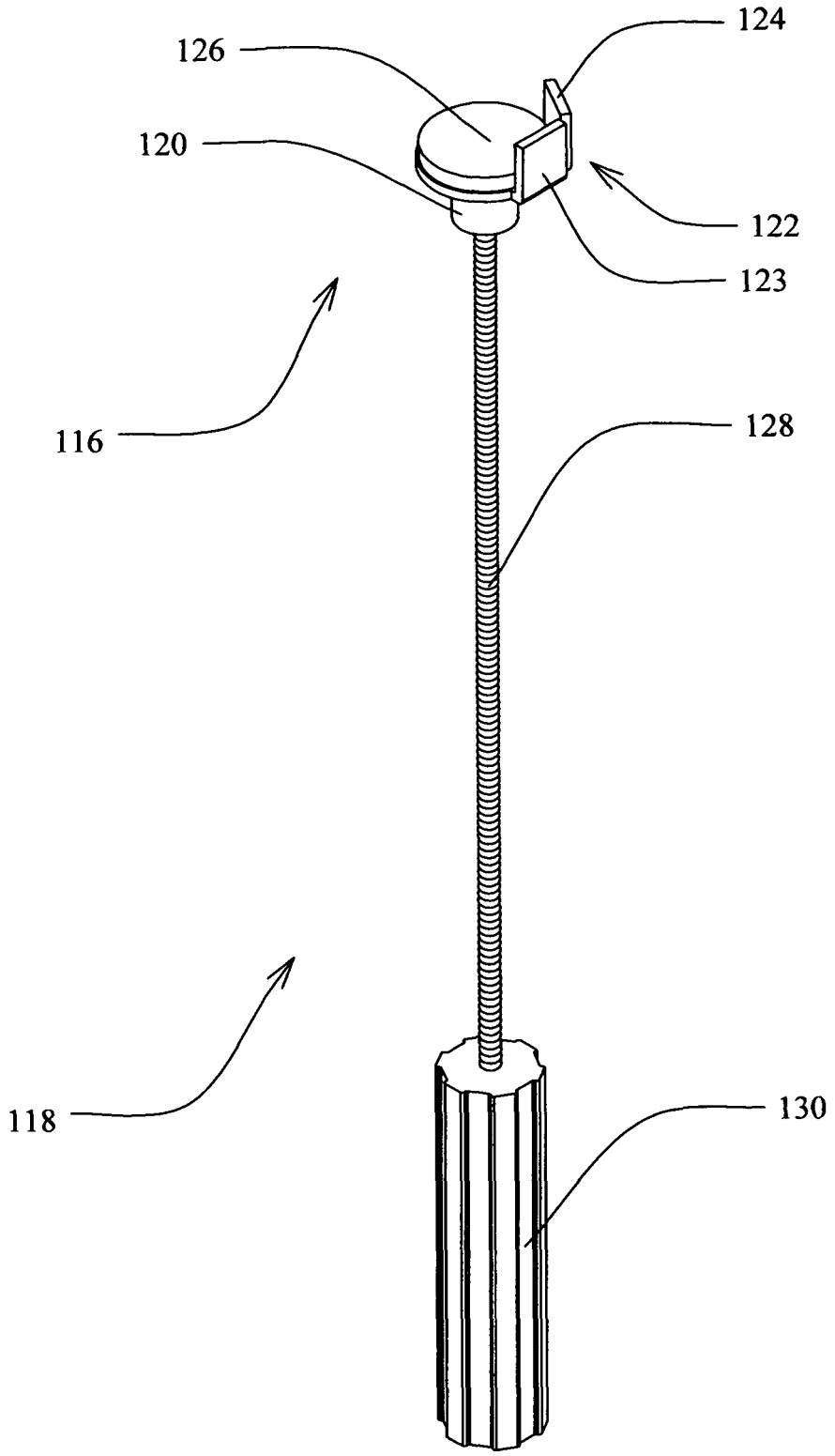
FIG. 1 is a perspective view showing a first embodiment in a relaxed state including an independent permanent magnet and a magnetic pole piece.
Figure 1A:
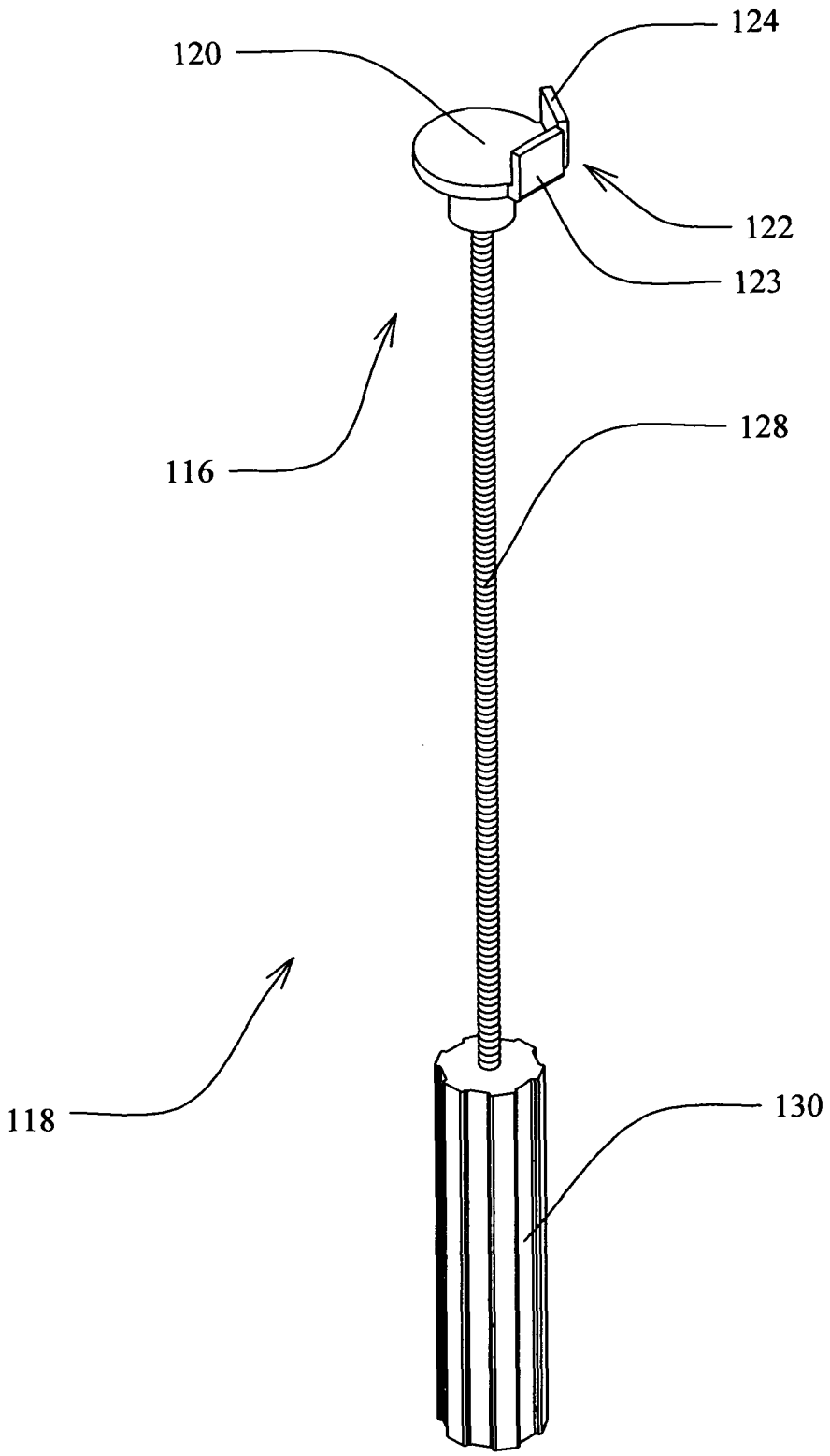
FIG. 1A is a perspective view showing the first embodiment in a relaxed state without an independent permanent magnet.
Figure 2:
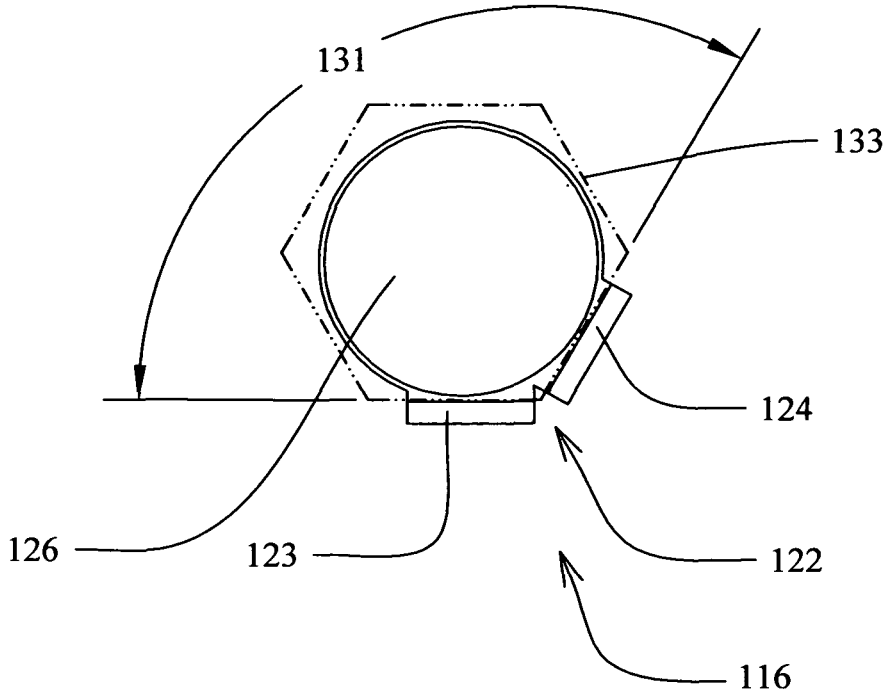
FIG. 2 is a top view of the first embodiment.
Figure 2A:
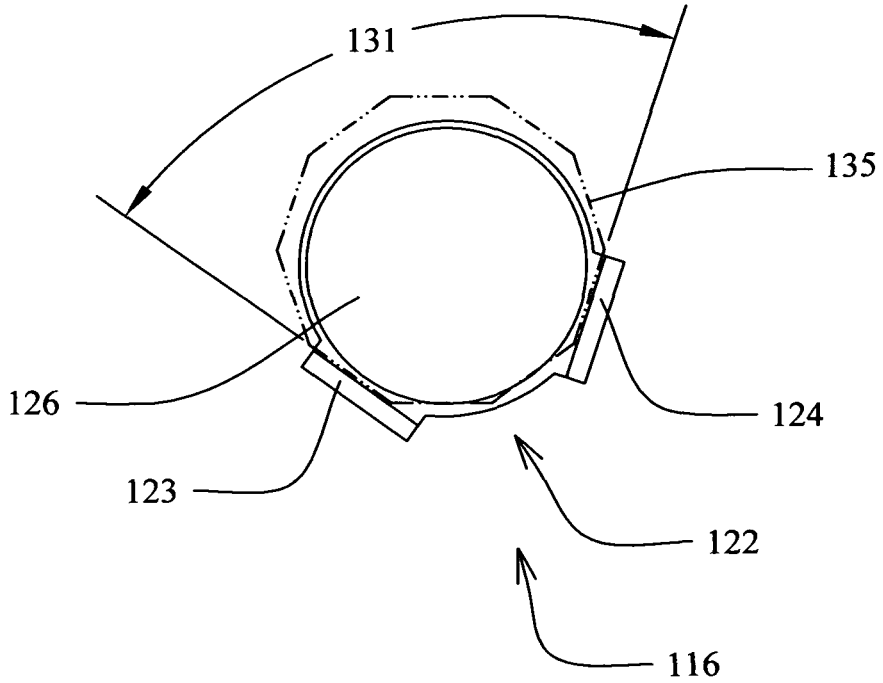
FIG. 2A is an alternate top view of the first embodiment.
Figure 3:
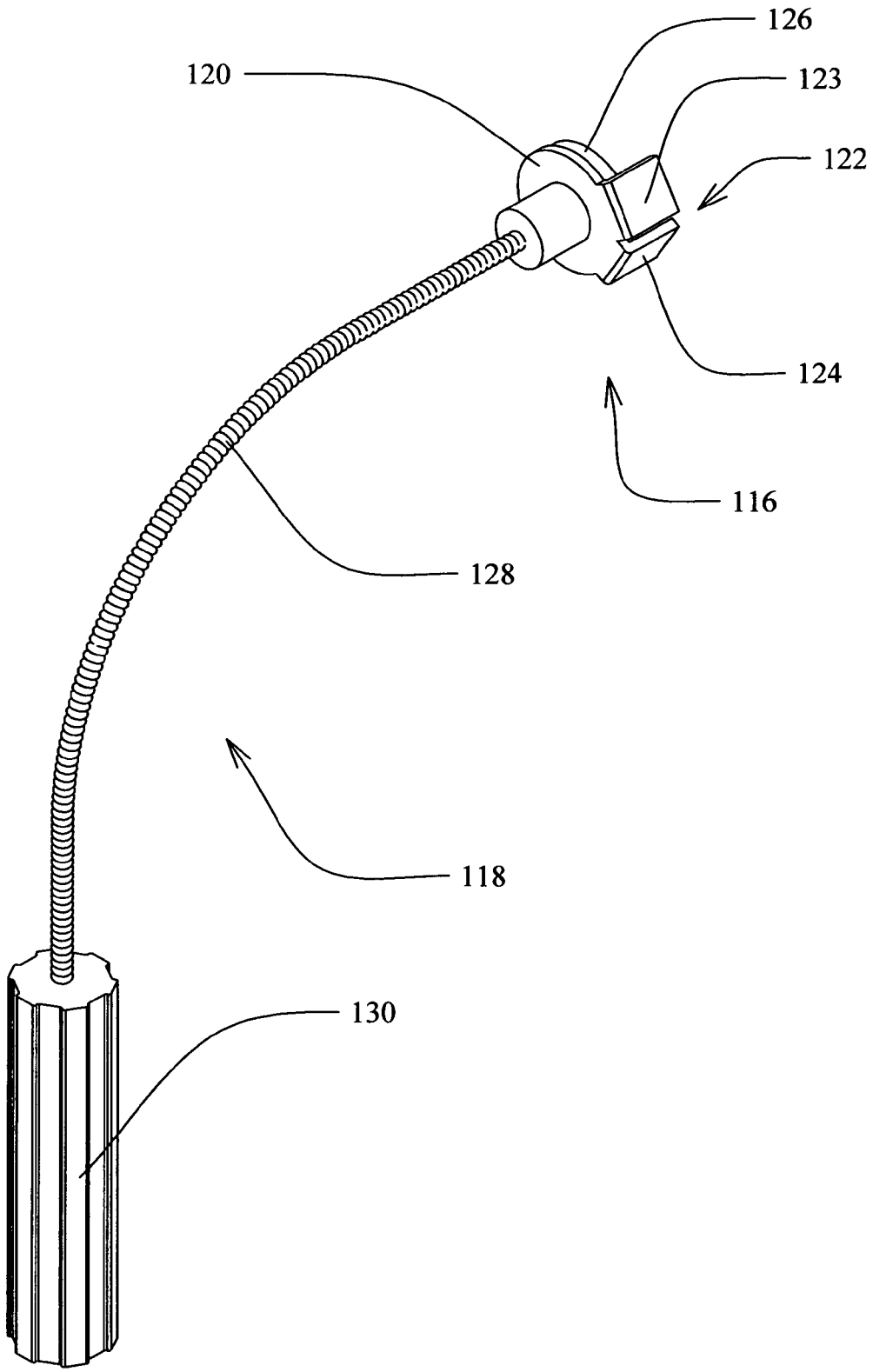
FIG. 3 is a perspective view showing the first embodiment in a flexed state.
Figure 4:
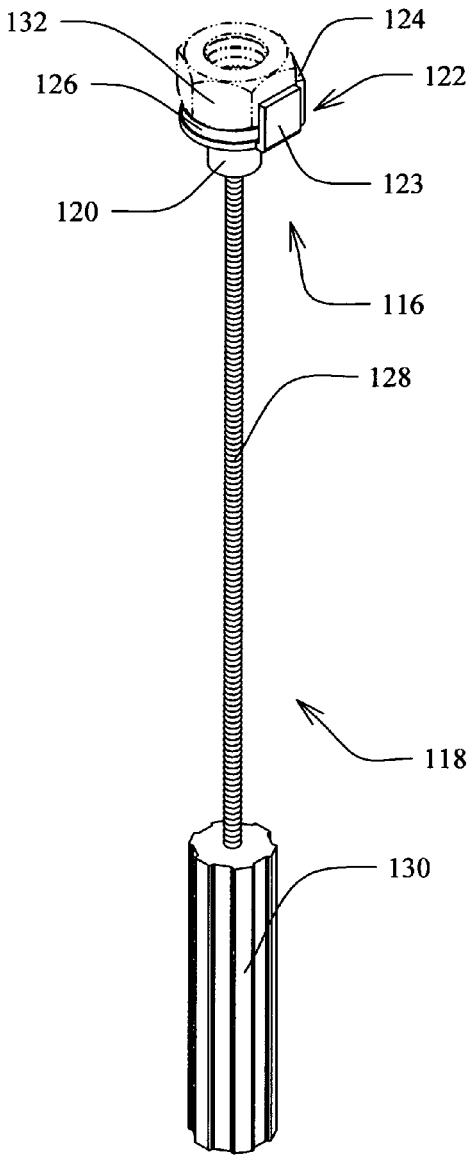
FIG. 4 is a perspective view showing a hex nut magnetically engaged with the first embodiment.
Figure 5:
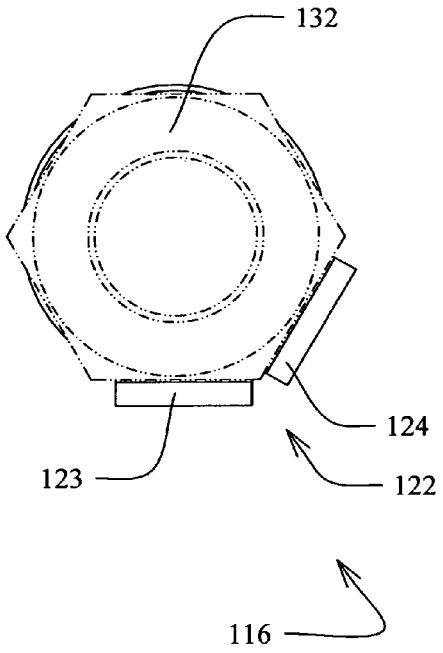
FIG. 5 is a top view showing the hex nut magnetically engaged with the first embodiment.

Referring to FIG. 1, FIG. 1A, FIG. 2, FIG. 2A, and FIG. 3, a first embodiment is shown. FIG. 1 shows a perspective view of the first embodiment in a relaxed or unflexed state including an independent permanent magnet and a magnetic pole piece. FIG. 1A shows a perspective view of the first embodiment in a relaxed or unflexed state without an independent permanent magnet. FIG. 2 shows a top view of the first embodiment and FIG. 2A shows an alternate top view of the first embodiment. FIG. 3 shows a perspective view of the first embodiment in a flexed state.

As shown in FIG. 1, the first embodiment includes a head assembly 116 and a drive assembly 118. The head assembly 116 includes a body 120, a magnetic pole piece 122 and an independent permanent magnet 126. The magnetic pole piece 122 includes a magnetic pole piece portion 123 and a magnetic pole piece portion 124 that are in a spaced relationship with respect to each other and form angle 131.

The drive assembly 118 includes a reboundable flexible shaft 128 and a handle 130. The top end of the flexible shaft 128 is attached to the lower side of the body 120 and the lower side of the permanent magnet 126, preferably of a disc configuration, is attached to the top side of the body 120. The permanent magnet 126 is coaxially attached to the body 120. The pole piece 122 is attached to the upper outer perimeter of the body 120 such that it is positioned beyond the outer perimeter of the magnet 126. The vertical length of the pole piece 122 is such that its height extends above the top of the magnet 126. The angle 131 formed between the inner face of the pole piece portion 123 and the inner face of the pole piece portion 124 is equal or approximately equal to the absolute value of 180°-360° m/n, where $n \geq 2m+1$, "n" is a positive whole number representing the number of sides of the prismatic shape, and "m" is a positive whole number representing the number of sides from a reference side on the prismatic shape.

The pole piece portion 123 and the pole piece portion 124 shown in FIG. 2 have an angle 131 applicable to adjacent sides (first side from a reference side) of a 6 sided prismatic shape 133 (shown as an outline for illustration) and therefore, the angle 131 shown is equal to 180°-360°×1/6=120°. If for example, the pole piece 122 had to connect to the third side from a reference side of a 10 sided prismatic shape 135 (shown as an outline for illustration), the angle 131 would be 180°-360°×3/10=72°, as shown in FIG. 2A.

The pole piece 122 is manufactured, at least in part, from a ferro-magnetic material, such as steel, to conduct the magnetic field into sides of the magnetic object's prismatic shape being magnetically engaged with the head assembly 116. The pole piece portion 123 and the pole piece portion 124 are separated from each other (discontinuous), as shown, or joined (continuous). Note that the head assembly 116 is configured to be spatially open opposite from the magnetic pole piece 122. The pole piece portion 123 and the pole piece portion 124, with respect to each other, can be of dissimilar sizes, shapes and surface areas with or without cutouts. Testing and research have shown that pole piece portions can have significantly varying sizes, shapes and surface areas with respect to each other, either with or without cutouts, and still perform adequately with respect to securing magnetic objects having prismatic shapes.

Alternately, as shown in FIG. 1A, the independent permanent magnet 126 can be eliminated from the head assembly 116 and permanently magnetizing the head assembly 116. The first embodiment has the same function regardless of whether the head assembly 116 is permanently magnetized or uses permanent magnet 126. In the following text and figures, the first embodiment with the magnet 126 integrated on the head assembly 116 will be used. The top side of the handle 130 is coaxially attached to the bottom end of the flexible shaft 128. The flexible shaft 128 is preferably manufactured from steel and the handle 130 is preferably manufactured from a light weight durable rigid material, such as plastic.

As an additional alternative to the first embodiment, the drive assembly 118 can be eliminated so that the first embodiment consists of the head assembly 116 and the head assembly 116 finger manipulated independently as described in the second embodiment.

Operation of the First Embodiment—FIG. 2, FIG. 2A, FIG. 3, FIG. 4, FIG. 5, FIG. 6 and FIG.

Most fasteners, bolts, nuts, plugs, screws, and the like are magnetic with at least a portion thereof having substantially prismatic shapes with 2 sides orientated, with respect to each other, at an angle that is approximately equal to the absolute value of 180°-360° m/n, where n≥2m+1, "n" is a positive whole number representing the number of sides of the prismatic shape, and "m" is a positive whole number representing the number of sides from a reference side on the prismatic shape. Since the angle 131 between the pole piece portion 123 and pole piece portion 124 conform to this spaced relationship, an infinite number of first embodiment pole piece portion configurations exist, one to match two sides of all prismatic shapes.

In the following explanation of the first embodiment operation, fasteners, bolts, nuts, plugs, screws, and the like incorporating hex prismatic shapes will be used as well as a pole piece 122 configuration applicable to adjacent sides (first side from a reference side) of a prismatic shape. The explanation of operation for fasteners, bolts, nuts, plugs, screws, and the like with other prismatic shapes is the same.

In operation, the end or end surface of a prismatic shape of a magnetic object, such as an end of a magnetic hex nut 132, is placed in contact with and magnetically attracted to the contact surface of the magnet 126. The magnetic field from the magnet 126 is conducted through the pole piece portions 123 and 124 and into the hex nut 132, which in turn pulls two sides of the nut 132 toward and into alignment with the pole piece portions 123 and 124, until the two side surfaces of nut 132 contact the pole piece portions 123 and 124. The nut 132 is now engaged with the head assembly 116 and therefore, reasonable torque can be applied by the shaft 128 and the handle 130 to screw and unscrew the nut 132 on and off its mating counterpart.

Required alignment of nut 132 with its mating counterpart is maintained by the flexibility of the shaft 128. Note that the first embodiment is universal in that all hex headed fasteners, bolts, nuts, plugs, screws, and the like of different sizes will fit on the first embodiment configuration with the pole piece portions 123 and 124 orientated 120 degrees with respect to each other. Likewise, note that the same universal characteristics of the first embodiment apply to all prismatic shapes of varying sizes having a common angle between two sides.

The small, unique, flexible, and universal design of the first embodiment makes the accomplishment of tedious, difficult, awkward, and messy operations a simple and easy job. With a threaded fastener, bolt, nut, plug, screw, or the like attached to the first embodiment, remote placement, initial installation, and/or final removal is easily performed in locations of limited access due to (1) the relatively small size of the first embodiment, (2) the strong attraction and hence, strong holding power of the magnet 126 and the pole piece portions 123 and 124, (3) the flexibility of the shaft 128, and (4) the capability for the extreme off axis rotation of the handle 130.

In many operations, a magnetic washer, spacer, or the like has to be installed prior to the installation of a nut or bolt in areas of limited access and at adverse orientations were, for example, the washer will fall off prior to installation of the nut or bolt, hence, making the installation of both the nut or bolt and washer very difficult. With the first embodiment, this operation is easy. Since the magnet 126 has high strength, its magnetic field is conducted through the nut 132 and therefore, a washer 137 can be magnetically held on the nut 132 at any orientation (due to the strong magnetic field of the magnet 126 exiting the nut 132 and entering the washer 137) and with full alignment maintained while both the nut 132 and washer 137 are installed in one operation.

Other operations require that a threaded fastener, bolt, nut, plug, screw, or the like be installed in an area of limited access where a tool or a person's fingers will not fit, making the initial installation of a nut on a bolt, for example, a challenge. In addition, if a ratchet wrench and socket are used for initial installation of the nut, usually the torque required to rotate the nut is less that the torque required to operate the ratchet mechanism, resulting in the nut not being able to be threaded unless a person's finger is placed on the socket or rotating portion of the wrench to increase the effective torque required for the wrench to ratchet and threadably engage the nut. In remote locations of limited access usually a finger cannot be placed on the socket or rotatable portion of the wrench making the nut installation process difficult.

Again, with the first embodiment, this operation is made simple. With the fingers of one hand holding the handle 130 and the fingers of the other hand holding and positioning the shaft 128, the nut 132 is easily positioned and aligned with the corresponding bolt, due to the flexibility of shaft 128, and self started by rotation of the handle 130. The final removal of the nut 132 becomes easy because the above ratchet wrench torque problems are eliminated and the nut 132 remains magnetically attracted to the first embodiment after removal, therefore, preventing loss of the nut 132.

Another extremely useful application of the first embodiment is to remove oil drain plugs from oil drain pans on engines, transmissions, differentials and the like. With respect to the conventional removal of drain plugs on engines in vehicles, especially cars and trucks, there are many problems, some of them relating to safety. In a typical oil draining process on a vehicular engine, the engine is operated for several minutes to heat the oil so that it will more easily flow from the engine's drain pan. After the oil is hot, the engine is stopped and an oil drain container is placed under the engine's drain plug. The vehicle may require jacking up and the use of jack stands. The drain plug is then loosened with a wrench and hand unscrewed and removed allowing the oil to drain into the drain container.

Usually, a number of adverse problems occur during a typical oil changing process, namely; (1) the hot oil flowing on a person's hand causing burning and/or irritation; (2) hot oil possibly splashing into a person's eyes causing severe damage; (3) the drain plug falling into the oil drain container requiring messy removal; (4) and/or oil splashing onto the floor requiring cleaning. These problems and the possible requirement for jacking up the vehicle can be eliminated with the use of the first embodiment.

Figure 6:
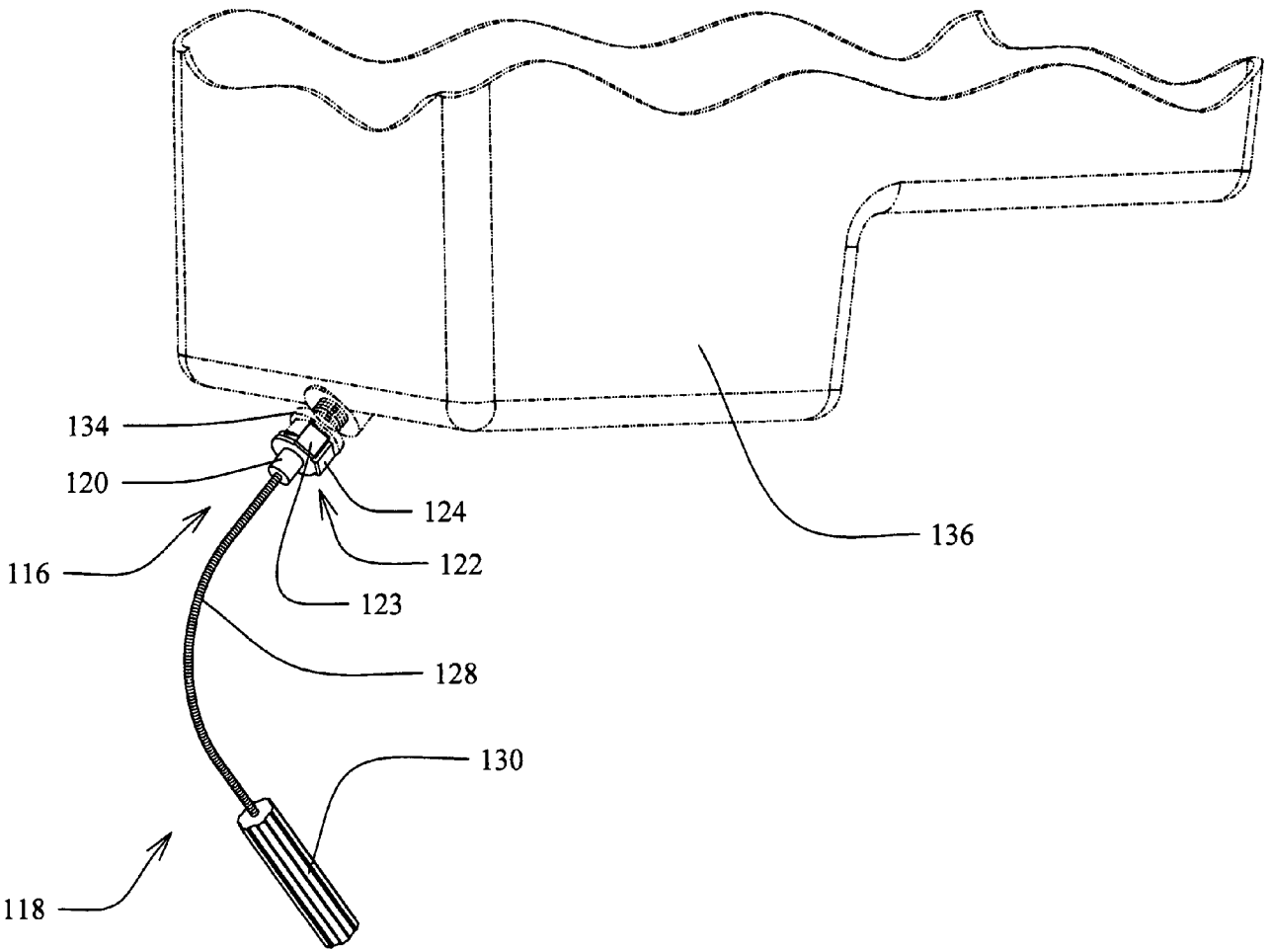
FIG. 6 is a perspective view showing the first embodiment being used to remove an oil drain plug from an engine oil pan.
Figure 7:
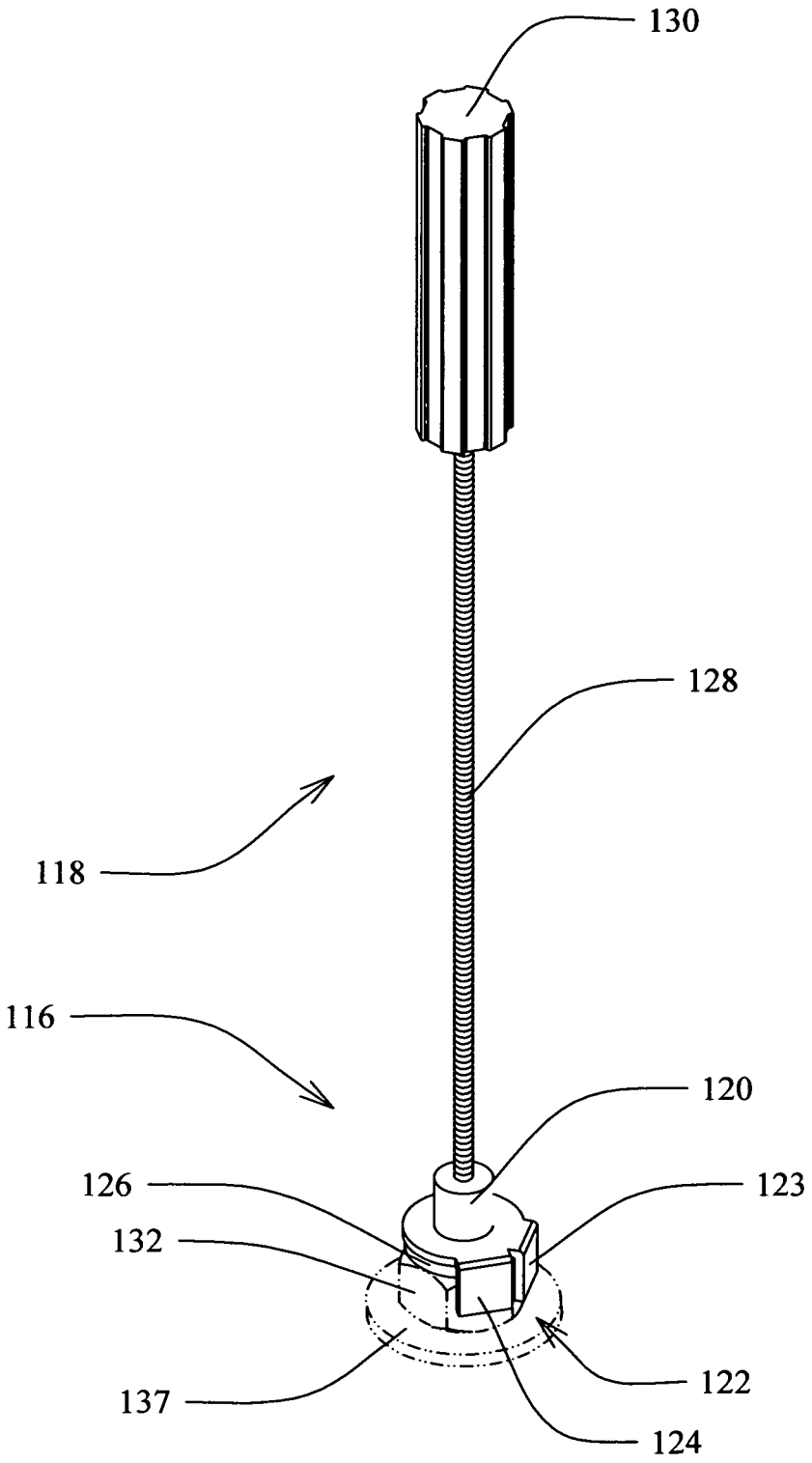
FIG. 7 is a perspective view showing a hex nut and a washer connected to the first embodiment for subsequent initial installation of the nut and the washer in the downward direction.

Referring to FIG. 6, a perspective view showing the first embodiment being used to remove an oil drain plug 134 from an engine's oil pan 136 is shown. With the first embodiment, the drain plug 134 is loosened with a conventional wrench. The head assembly 116 of the first embodiment is magnetically engaged with the drain plug 134. The shaft 128 can then be flexed to place the handle 130 in a desirable remote location and orientation. Next, the drain plug 134 can be unscrewed by rotating the handle 130. After the drain plug 134 has been fully unscrewed, the plug 134 automatically falls downward by the force of gravity until limited by the flexing of the shaft 128 and out of the way of the oil stream.

With the first embodiment, it is emphasized that (1) by remote removal of the plug 134, body contact with the hot oil can be essentially eliminated, (2) oil splashing, if any, can be negligible due to the automatic and quick removal of the plug 134 from the oil stream, and (3) the plug 134 will not fall in the drain container since the plug 134 remains engaged with the first embodiment. The requirement for jacking up the vehicle is not normally required since the first embodiment removes the drain plug 134 remotely from off axis orientations and therefore, usually the arm is the only part of the body that has to be placed under the vehicle.

With respect to the alternatives of the first embodiment, the head assembly 116 can be finger manipulated by contacting directly as described in the second embodiment.

Second Embodiment

FIG. 8

Figure 8:
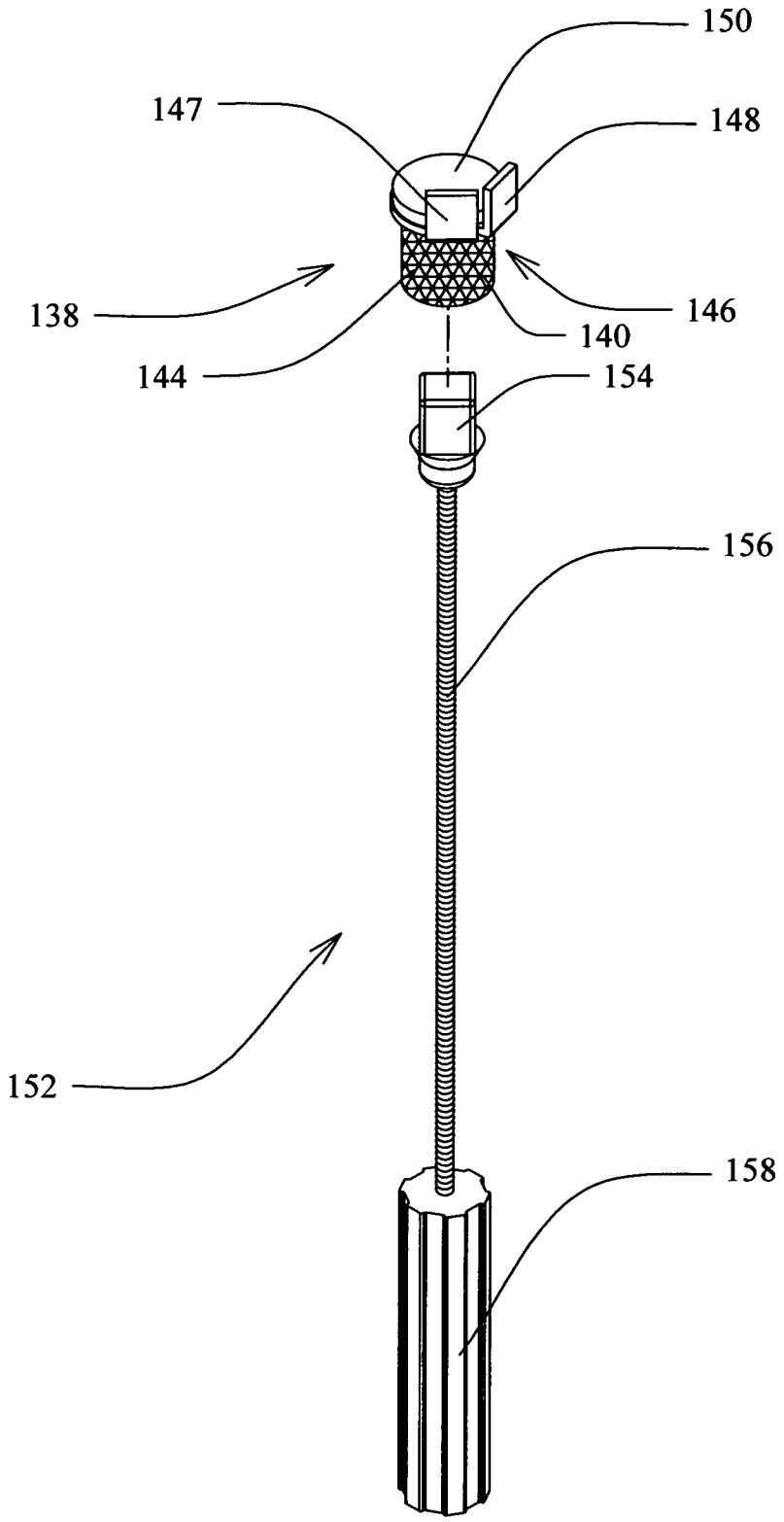
FIG. 8 is a partially exploded perspective view of a second embodiment.

Referring to FIG. 8, a second embodiment is shown. The second embodiment includes a head assembly 138 and may include a driver 152. The head assembly 138 includes a body 140, a magnetic pole piece 146 and a permanent magnet 150. The magnetic pole piece 146 includes magnetic pole piece portion 147 and a magnetic pole piece portion 148. The pole piece portion 147 and the pole piece portion 148 can be separated from each other (discontinuous), as shown, or joined (continuous). The body 140, the pole piece 146, the pole piece portion 147, the pole piece portion 148, and the magnet 150 can be configured, connected, and orientated, respectively to each other in the same manner as the body 120, the pole piece 122, the pole piece portion 123, the pole piece portion 124 and the magnet 126, respectively, are in the first embodiment. Note that the head assembly 138 is configured to be spatially open opposite from the magnetic pole piece 146.

As with first embodiment, the pole piece portion 147 and the pole piece portion 148 can be of dissimilar sizes, shapes and surface areas. Testing and research have shown that pole piece portions can have significantly varying sizes, shapes and surface areas with respect to each other and still perform adequately with respect to securing magnetic objects having prismatic shapes. In the same manner as with the first embodiment, the magnet 150 can be eliminated and the head assembly 138 permanently magnetized. In addition, the pole piece 146 can be manufactured from the same material as the pole piece 122 of the first embodiment.

Furthermore, the spaced relationship between the pole piece portion 147 and pole piece portion 148 is the same as in the first embodiment. The body 140 has two differences from the body 120, namely, a socket 142 in its lower side (see FIG. 9 and FIG. 10) and a knurl 144 on its outside periphery. The driver 152 includes a drive post 154, a reboundable flexible driver shaft 156, and a handle 158. The lower side of the drive post 154 is connected coaxially with the upper end of the shaft 156 and the lower end of the shaft 156 is connected coaxially with the handle 158. The socket 142 is designed to accommodate the drive post 154.

As another alternative, the driver 152 can be eliminated and the head assembly 138 used independently.

Figure 9:
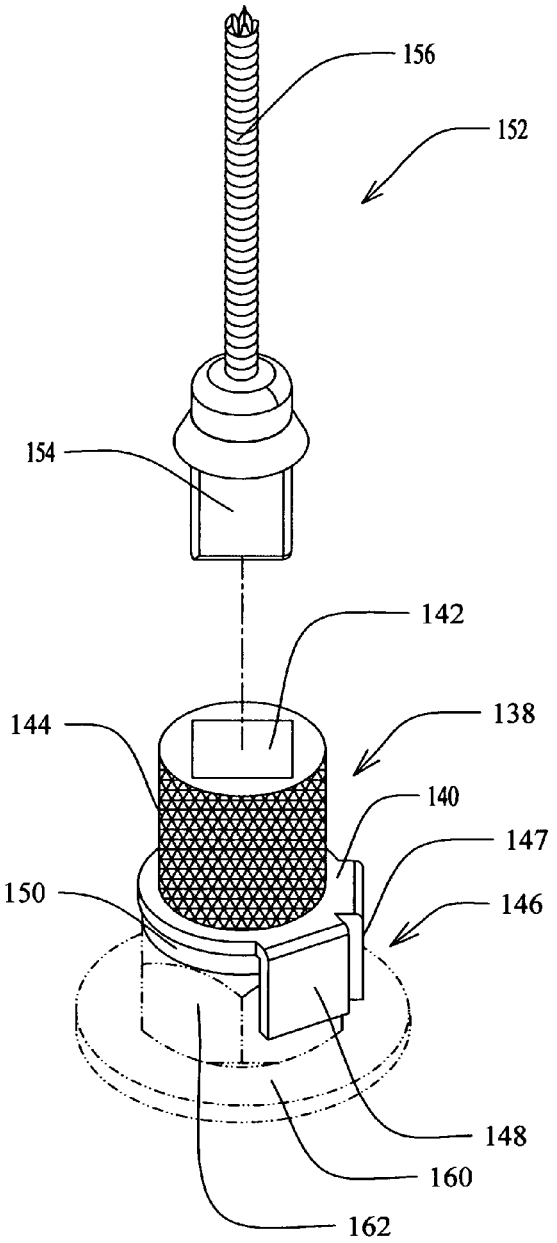
FIG. 9 is a partially exploded perspective view showing a hex nut and a washer connected to the second embodiment for subsequent initial installation of the nut and the washer in the downward direction.
Figure 10:
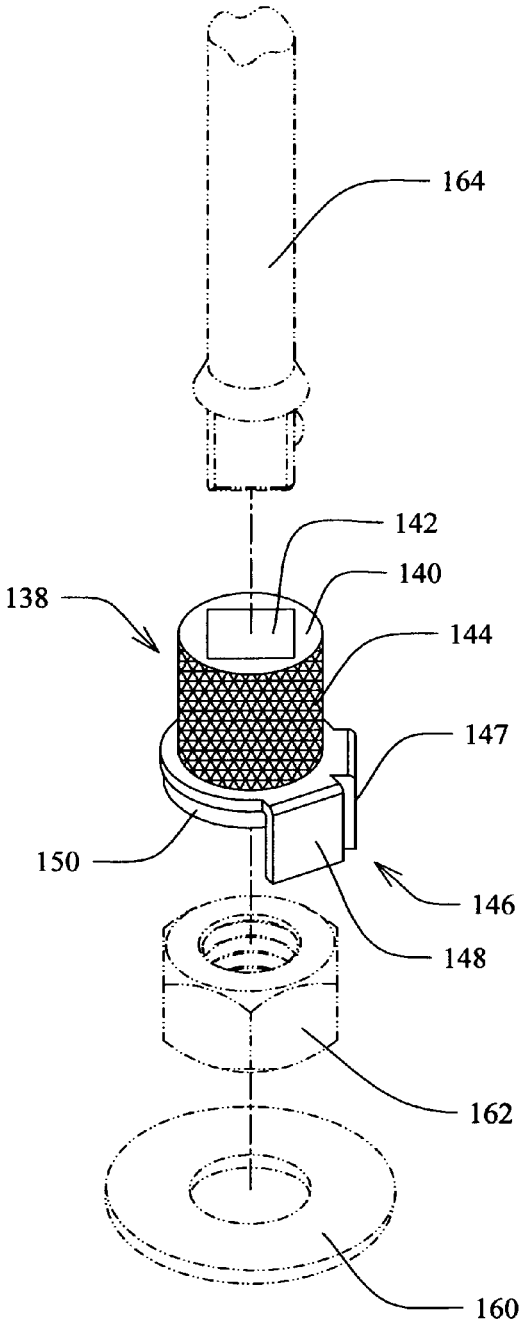
FIG. 10 is a partially exploded perspective view showing a hex nut, a washer, and a socket wrench extension bar connected to a head of the second embodiment for subsequent initial installation of the nut and the washer in the downward direction.

Operation of the Second Embodiment—FIG. 8, FIG. 9, and FIG. 10

In general, the operation and uses of the second embodiment are the same as the first embodiment with the exception that the head assembly 138 of second embodiment can be positioned and rotated in one of three ways, namely by direct finger rotation; by use of a socket wrench without or with accessories, such as a ratchet wrench and extension bar, connected to the socket 142; and by use of the driver 152. Engaging an end of the prismatic shape of a fastener, bolt, nut, plug, screw, and the like with the head assembly 138 is the same as with first embodiment. When the head assembly 138 is coupled to the driver 152 by inserting the drive post 154 into the socket 142, the combined assembly essentially functions the same as the first embodiment, therefore, operation and uses are the same as with the first embodiment.

In some instances, access can be limited but does not require remote rotation. In this case, the driver 152 is not used and the head assembly 138 is manually rotated by finger contact with the knurl 144. In other instances, access may or may not be limited but requires significant remote positioning and rotation of the head assembly 138 using socket wrenches with or without accessories connected to the socket 142.

In a manner similar to the embodiment, FIG. 9 shows the second embodiment made ready for initial installation of both a nut 162 and a washer 160 in the downward direction, while maintaining the nut 162 to the washer 160 alignment. FIG. 10 shows an extension bar 164 coupled to the head assembly 138 for initial installation of the nut 162 and the washer 160 in a downward direction. In addition, the driver 152 can be used with conventional sockets and socket accessories to remotely perform placement, initial installation, and/or final removal of fasteners, bolts, nuts, plugs, large screws, and the like in locations of limited access.

Third Embodiment

Figure 11:
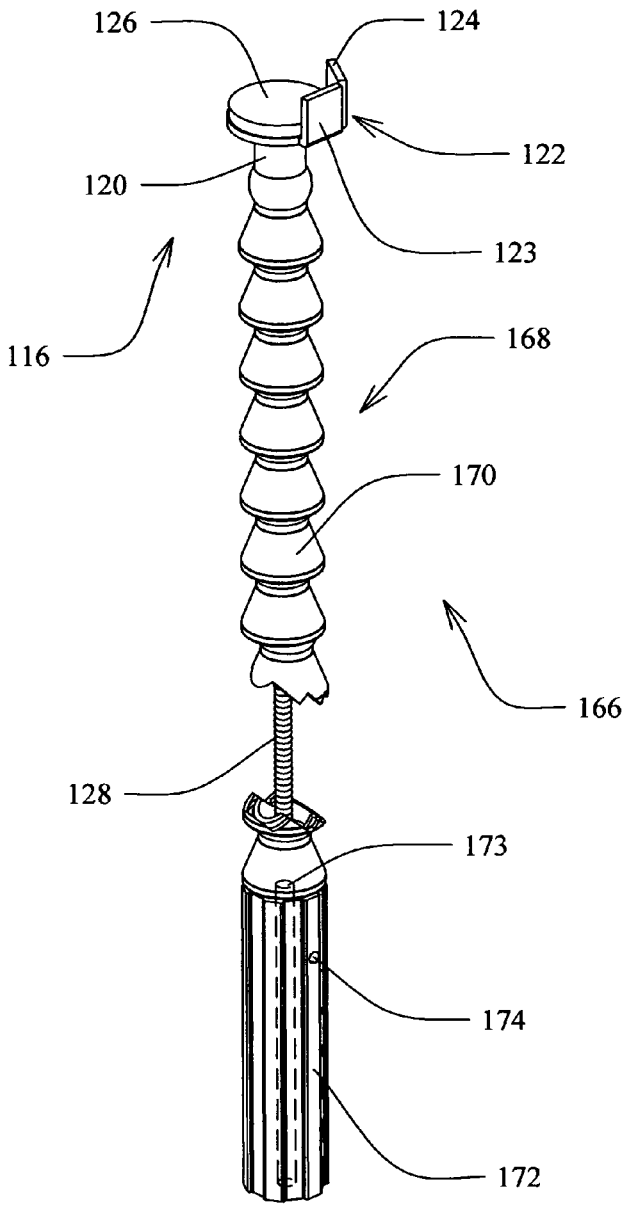
FIG. 11 is a perspective view showing a third embodiment in a generally straight configuration with an independent permanent magnet and a magnetic pole piece.
Figure 12:
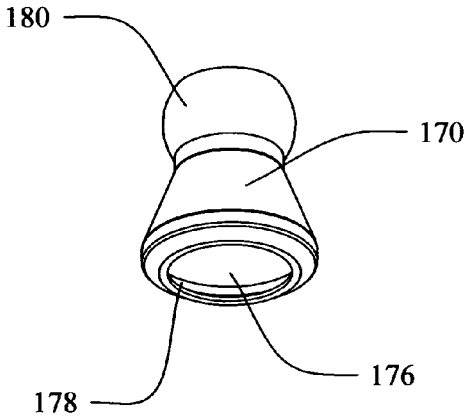
FIG. 12 is a perspective view of a modular link in an adjustable arm used in the third embodiment.
Figure 13:
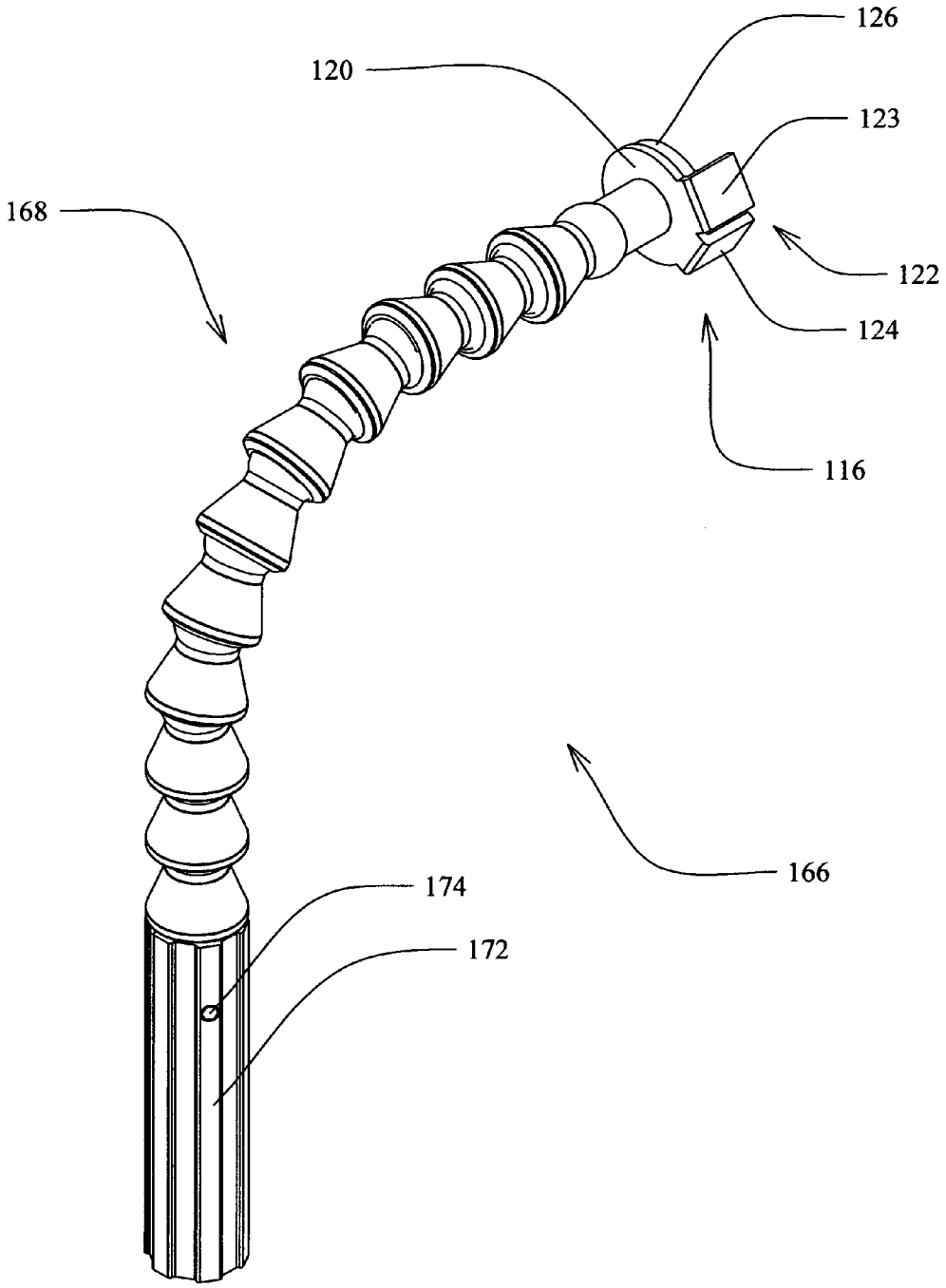
FIG. 13 is a perspective view showing the third embodiment in an arcuate configuration.

FIG. 11, FIG. 12, and FIG. 13

Referring to FIG. 11, FIG. 12, and FIG. 13, a third embodiment is shown. FIG. 11 shows a perspective view of the third embodiment in a straight configuration with a magnetic pole piece. FIG. 12 shows a perspective view of a modular link in an adjustable arm used in the third embodiment and FIG. 13 shows a perspective view of the third embodiment in a arcuate configuration.

The third embodiment includes the head assembly 116 of the first embodiment and a drive assembly 166. The drive assembly 166 includes the flexible shaft 128 used in the first embodiment, an adjustable modular arm assembly or semi-rigid adjustable arm assembly 168, and a handle 172. The flexible shaft 128 is attached to the head assembly 116 in the same manner as in the first embodiment.

The adjustable modular arm assembly 168 includes a number of individual links 170 connected in series with each other. FIG. 12 shows a perspective view of one of the links 170. Each of the links 170 includes a ball end 180, a socket end 178, and a through hole 176. Each of the links 170 is connected so that the ball end 180 fits into the socket end 178 of the adjacent link 170. The design of each link 170 is such that an interference fit is maintained between the ball end 180 and the socket end 178 thereby, permitting rotation and twisting between each adjacent link 170 and the subsequent retainment of orientation between each adjacent link 170. The handle 172 includes a through hole 173 along its center axis that accommodates the end of the flexible shaft 128, opposite from that connected to the head assembly 116, and a set screw 174 to retain the end of the flexible shaft 128 in the handle 172. The adjustable modular arm assembly 168 is assembled into the third embodiment such that the flexible shaft 128 passes through each through hole 176 in each link 170 and is held in place by the bottom end of the head assembly 116 and the top end of the handle 172 by tightening the set screw 174 or by using other securing methods.

Operation of the Third Embodiment—FIG. 4, FIG. 5, FIG. 6, FIG. 7, FIG. 11, and FIG. 13

In general, the operation and uses of the third embodiment are the same as the first embodiment and with added capability. In the third embodiment, the modular arm assembly 168 can be (1) configured to retain the flexible shaft 128 in a pre-configured curve and (2) removed from the third embodiment resulting in the third embodiment functioning essentially the same as the first embodiment. With the flexible shaft 128 being retained in a pre-configured curve by adjustment of the modular arm assembly 168, the third embodiment has a further more controlled reach into distant areas of limited access with respect to remote placement, initial installation, and/or final removal of fasteners, bolts, nuts, plugs, large screws, and the like, than the first embodiment.

In operation, the prismatic shape of the selected magnetic object is engaged with the head assembly 116 in the same manner as in the operation of the first embodiment. The modular arm assembly 168 is then configured into the required curve and the head assembly 116 placed in position to install the fastener, bolt, nut, plug, large screw, or the like. With one hand holding the modular arm assembly 168, the other hand rotates the handle 172, which in turn rotates the flexible shaft 128 and the head assembly 116, to initially install the fastener, bolt, nut, plug, large screw, or the like. Final removal of a fastener, bolt, nut, plug, large screw, or the like, is accomplished in a somewhat similar manner.

To configure the third embodiment like the first embodiment, the set screw 174 is loosened and the flexible shaft 128 removed from the handle 172. The modular arm assembly 168 is then removed from the flexible shaft 128, the flexible shaft 128 re-inserted back into the handle 172 and the set screw 174 re-tightened.

Fourth Embodiment

FIG. 14

Figure 14:
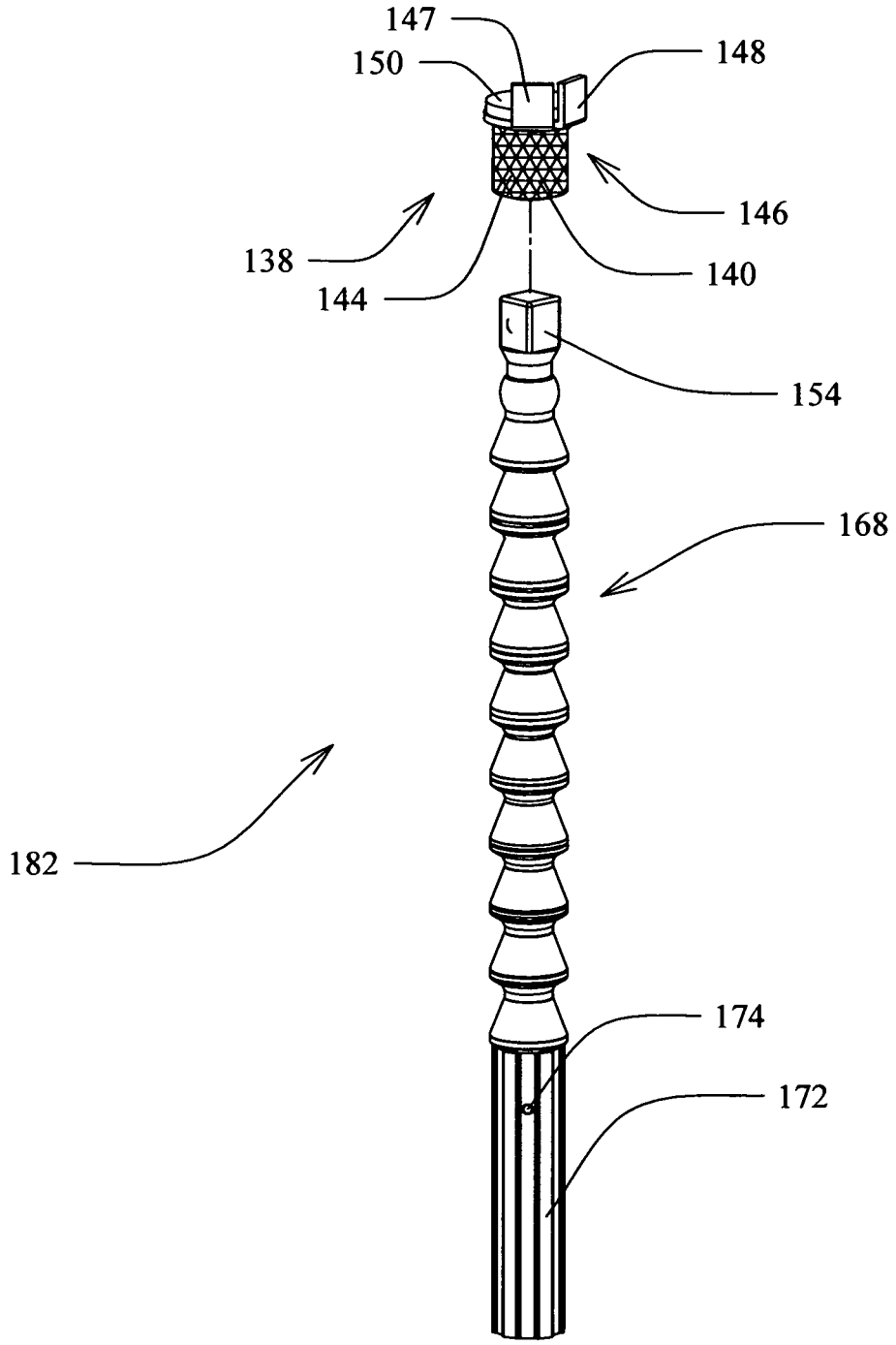
FIG. 14 is a partially exploded perspective view of a fourth embodiment.

Referring to FIG. 14 a fourth embodiment is shown. FIG. 14 shows a perspective view of the fourth embodiment. The fourth embodiment includes a driver 182 and the head assembly 138 of the second embodiment. The driver 182 includes the drive post 154, the flexible driver shaft 156 of the second embodiment (see FIG. 8), the adjustable modular arm assembly or semi-rigid adjustable arm assembly 168 and the handle 172 of the third embodiment (see FIG. 11). The lower side of the drive post 154 is connected coaxially with the upper end of the flexible shaft 156.

As with the third embodiment, the flexible shaft 156 is passed through each through hole 176 in each link 170 of the modular arm assembly 168. The modular arm assembly 168 is held in place by the lower side of the drive post 154 and the top end of the handle 172 by tightening the set screw 174. The driver 182 is connected to the head assembly 138 by inserting the drive post 154 into the socket 142 of the head assembly 138. In the same manner as with the first embodiment, the magnet 150 can be eliminated and the head assembly 138 permanently magnetized.

Operation of the Fourth Embodiment—FIG. 8, FIG. 9, FIG. 10, and FIG. 14

In general, the operation and uses of the fourth embodiment are the same as the second embodiment with added capability. With the fourth embodiment, the modular arm assembly 168 can be (1) configured to retain the flexible shaft 156 in a pre-configured curve and (2) removed from the driver 182 resulting in the fourth embodiment being essentially the same as the second embodiment. With the flexible shaft 156 being retained in a pre-configured curve by adjustment of the modular arm assembly 168, the fourth embodiment has a further more controlled reach into distant areas of limited access, with respect to remote placement, initial installation, and/or final removal of fasteners, bolts, nuts, plugs, large screws, and the like, than the second embodiment.

In operation, the drive post 154 of the driver 182 is inserted into the socket 142 of the head assembly 138. Next, the prismatic shape of the selected magnetic object is engaged with the head assembly 138 in the same manner as in the operation of the second embodiment. The modular arm assembly 168 is then configured into the required curve and the head assembly 138 placed in position to perform placement, initial installation, and/or final removal of a fastener, bolt, nut, plug, large screw, or the like. With one hand holding the modular arm assembly 168, the other hand rotates the handle 172, which in turn rotates the flexible shaft 156 and the head assembly 138, to initially install the fastener, bolt, nut, plug, large screw, or the like. Final removal of the fastener, bolt, nut, plug, large screw, or the like, can be accomplished in a somewhat similar manner.

To configure the fourth embodiment similar to the second embodiment, the set screw 174 is loosened and the flexible shaft 156 removed from the handle 172. The modular arm assembly 168 is then removed from the flexible shaft 156, the flexible shaft 156 re-inserted back into the handle 172, and the set screw 174 re-tightened. As with the second embodiment, the head assembly 138 can be removed from the driver 182 and used independently. In addition, the driver 182 can be used with conventional sockets and socket accessories to remotely perform placement, initial installation, and/or final removal of fasteners, bolts, nuts, plugs, large screws, and the like in locations of limited access.

Fifth Embodiment

FIG. 15, FIG. 15A, FIG. 16 and FIG. 17

Figure 15:
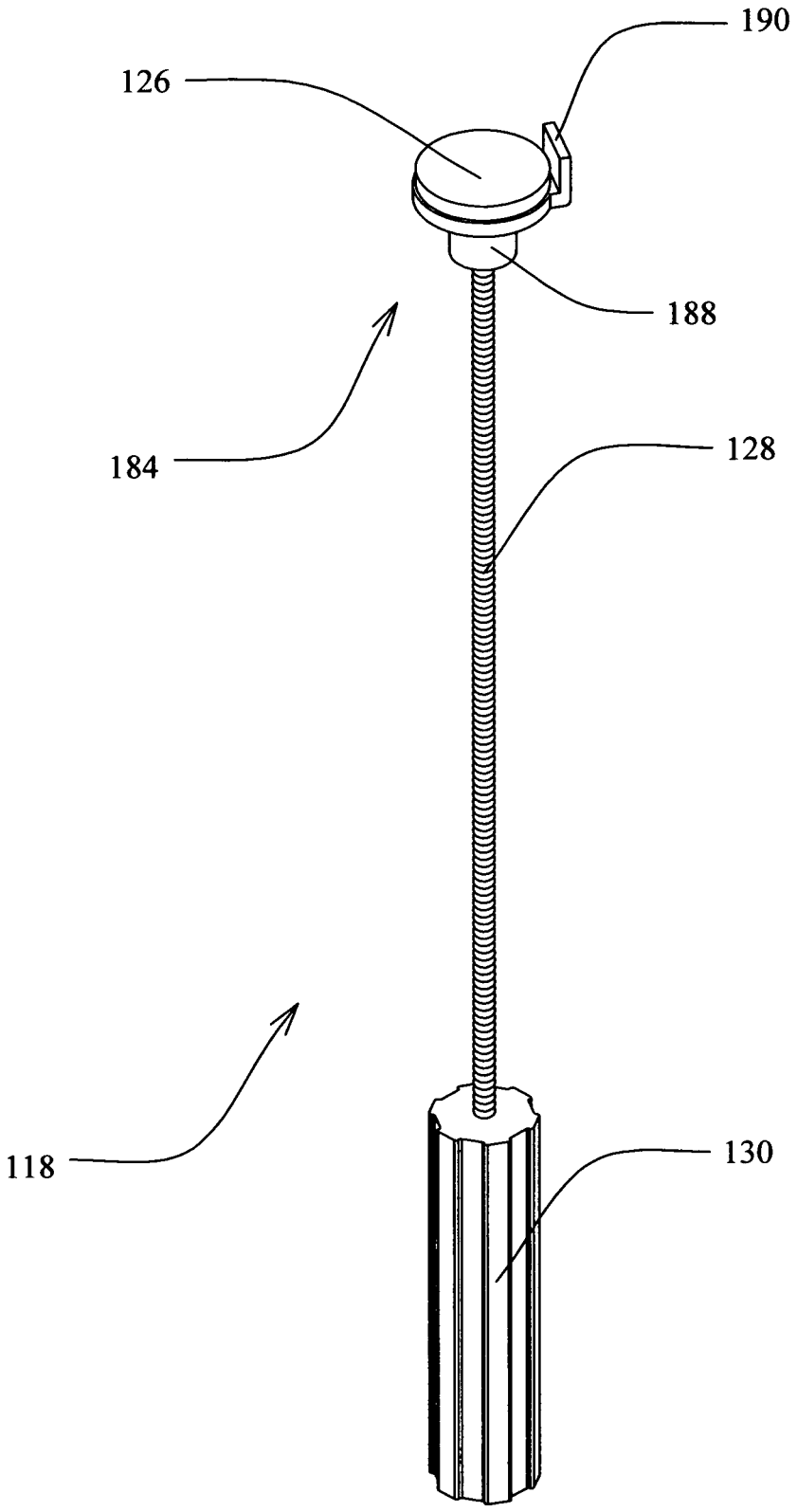
FIG. 15 is a perspective view showing a fifth embodiment in a relaxed state including an independent permanent magnet and a magnetic pole piece.
Figure 15A:
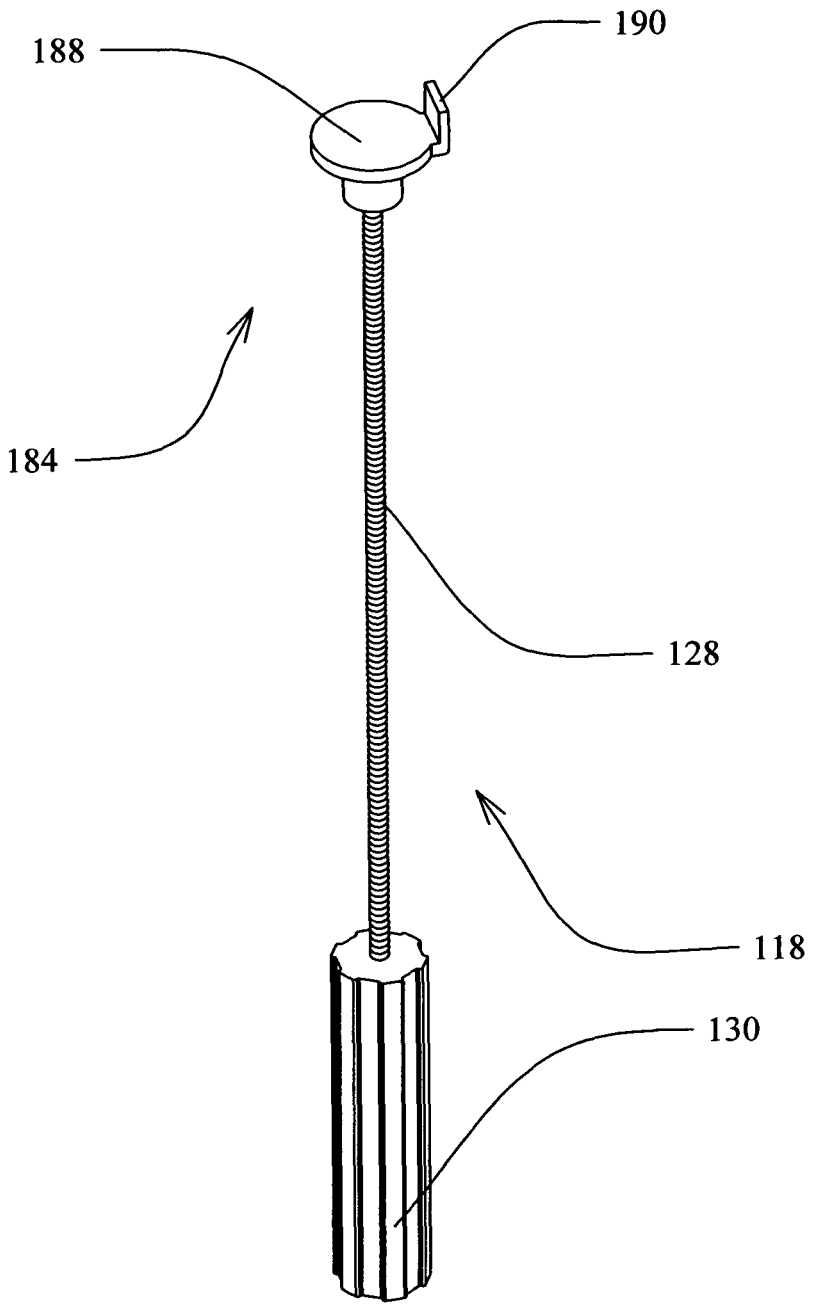
FIG. 15A is a perspective view showing the fifth embodiment in a relaxed state without an independent permanent magnet.
Figure 16:
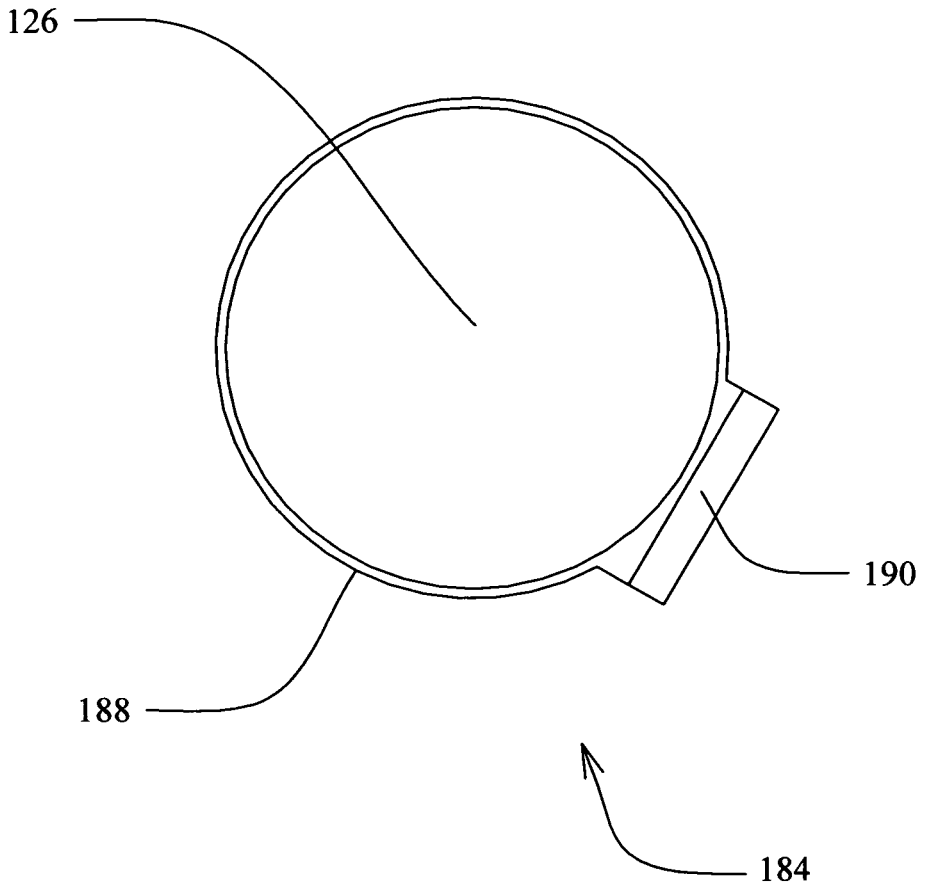
FIG. 16 is a top view of the fifth embodiment.
Figure 17:
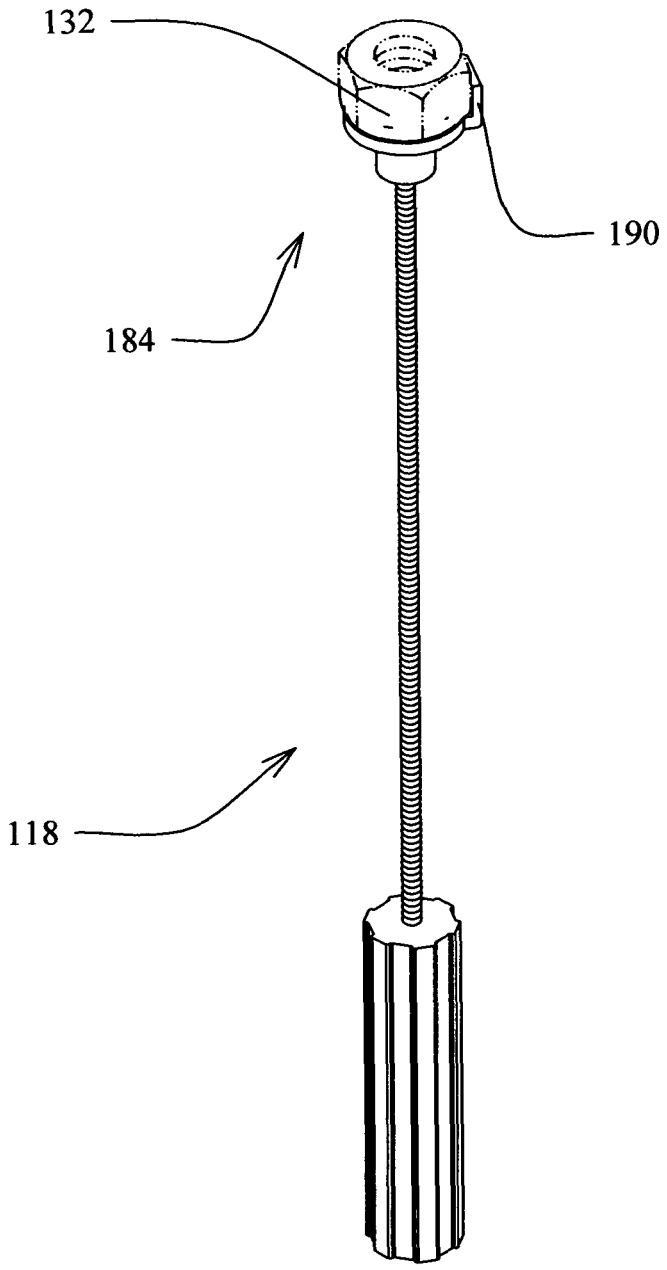
FIG. 17 is a perspective view showing a hex nut magnetically engaged with the fifth embodiment.

Referring to FIG. 15, FIG. 15A, FIG. 16 and FIG. 17, a fifth embodiment is shown. FIG. 15 shows a perspective view of the fifth embodiment in a relaxed state including an independent permanent magnet and a magnetic pole piece. FIG. 15A shows a perspective view of the fifth embodiment in a relaxed state without an independent permanent magnet. FIG. 16 shows a top view of the fifth embodiment and FIG. 17 shows a perspective view of a hex nut magnetically engaged with the fifth embodiment.

As shown in FIG. 15, the fifth embodiment includes a head assembly 184 and the drive assembly 118. The head assembly 184 includes a body 188, a magnetic pole piece 190 and the independent permanent magnet 126. The magnet 126, the magnetic pole piece 190 and the drive assembly 118 attach to the head assembly 184 in the same manner as in the first embodiment. The pole piece 190 has the same configuration as either the pole piece portion 123 or the pole piece portion 124 in the first embodiment. Note that the head assembly 184 is configured to be spatially open opposite from the magnetic pole piece 190. As with the first embodiment, another alternative of the fifth embodiment can be created by eliminating the magnet 126 from head assembly 184 and permanently magnetizing the head assembly 184, as shown in FIG. 15A.

Testing and research have shown that with the proper magnetization, a magnetic pole piece with a single pole piece portion can provide adequate securing of a magnetic object having a prismatic shape by contacting a single side surface of the magnetic object 132, as shown in FIG. 17. The magnetic pole piece 190 can have a different size, shape and/or surface area, either with or without a cutout(s), from that shown.

As an additional alternative, the modular arm assembly 168 can be installed on all versions of the fifth embodiment to hold the flexible shaft 128 in a pre-determined configuration, as with the third embodiment. As another alternative, the drive assembly 118 can be eliminated and the head assembly 184 finger manipulated independently or configured with a socket 142, as on the second embodiment, and used with a drive post on an installation tool, such as drivers 152 and 182. In still an additional alternative, the drive assembly 118 can be eliminated and the head assembly 184 finger manipulated and it can include a knurl 144 on its outside periphery to enhance finger manipulation.

Operation of the Fifth Embodiment—FIG. 17

The operation of the fifth embodiment is the same as with the first, second and third embodiments, as applicable, with only one side of the magnetic object 132 engaged with pole piece 190. If modular arm assembly 168 is included in the fifth embodiment, then the fifth embodiment can be operated like the third embodiment with respect to configuring the drive assembly 118.

With respect the fifth embodiment and its alternatives, the head assembly 184 can be finger manipulated by contacting it directly.

Sixth Embodiment

FIG. 18, FIG. 19, FIG. 20, FIG. 21, FIG. 22 and FIG. 23

Figure 18:
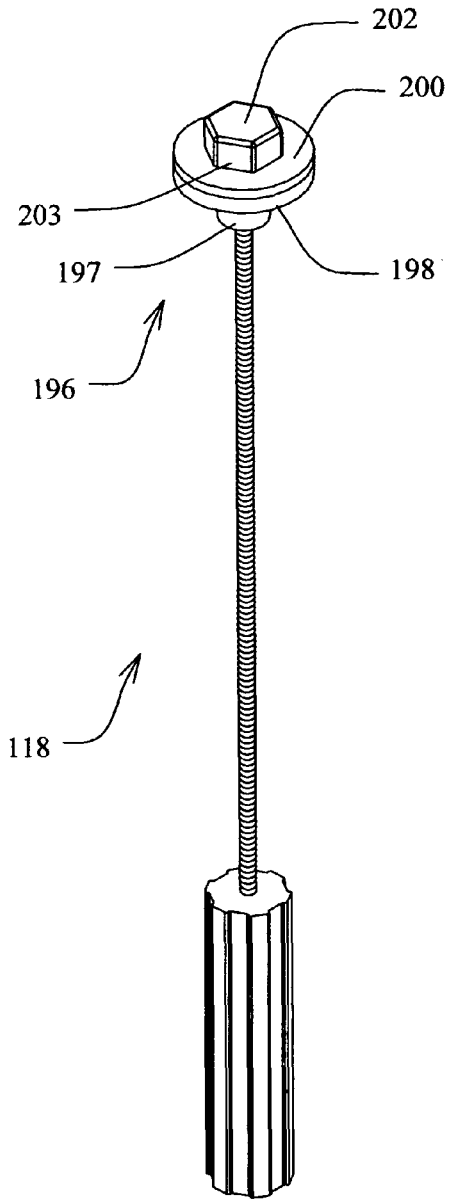
FIG. 18 is a perspective view showing a sixth embodiment with a hexagonal prismatic magnetic pole piece in a relaxed state including an independent permanent magnet.
Figure 19:
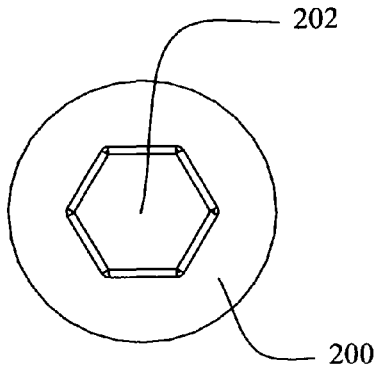
FIG. 19 is a top view of the sixth embodiment.
Figure 20:
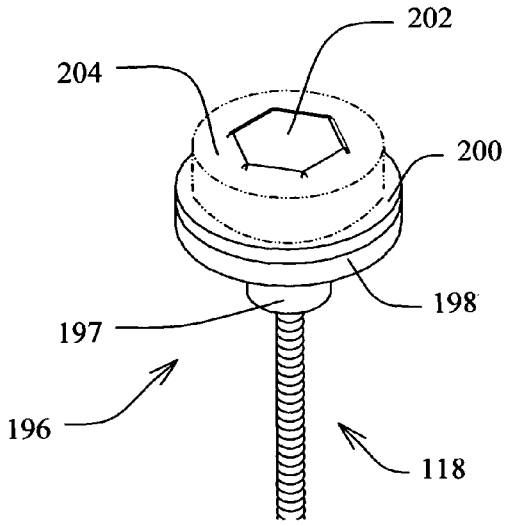
FIG. 20 is a perspective view showing the sixth embodiment magnetically engaged with a hexagonal cavity of a component.
Figure 21:
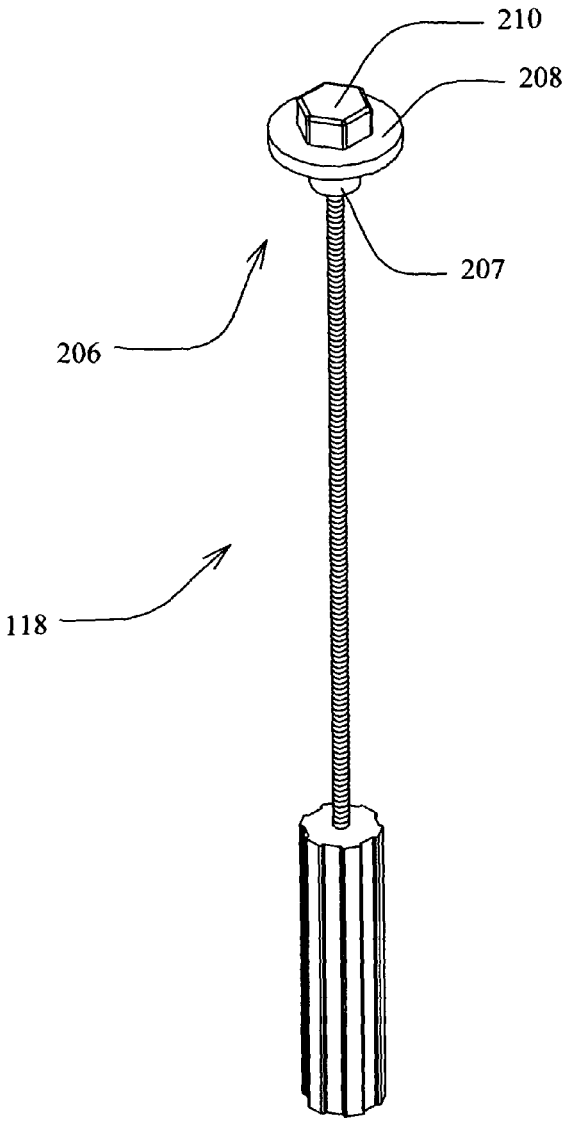
FIG. 21 is a perspective view showing a first alternate version of the sixth embodiment with a hexagonal prismatic magnetic pole piece in a relaxed state having an independent permanent magnet but without a magnet support base.
Figure 22:
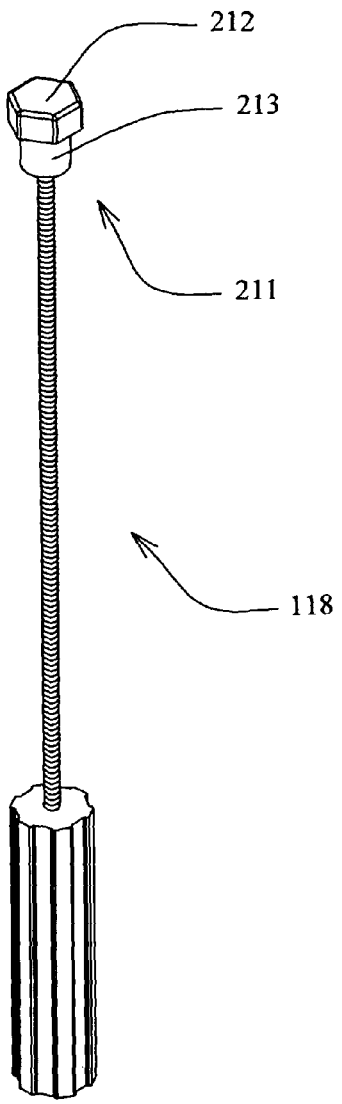
FIG. 22 is a perspective view showing a second alternate version of the sixth embodiment in a relaxed state with a permanently magnetized head assembly having a hexagonal prismatic magnetic pole piece.
Figure 23:
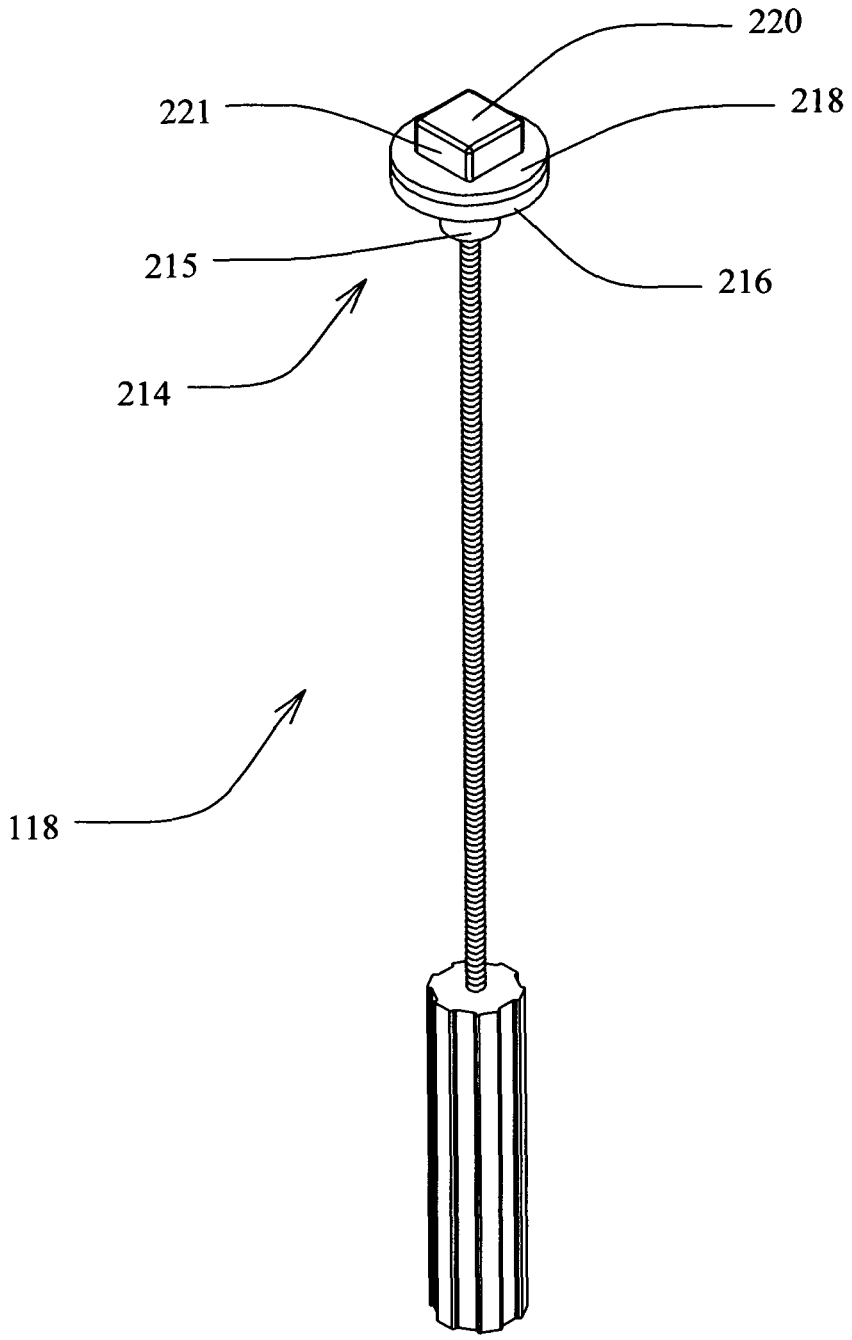
FIG. 23 is a perspective view showing a third alternate version of the sixth embodiment with a cubic prismatic magnetic pole piece in a relaxed state including an independent permanent magnet.

Referring to FIG. 18, FIG. 19, FIG. 20, FIG. 21, FIG. 22 and FIG. 23, a sixth embodiment is shown. FIG. 18 shows a perspective view of a sixth embodiment with a hexagonal prismatic magnetic pole piece in a relaxed state including an independent permanent magnet. FIG. 19 shows a top view of the sixth embodiment while FIG. 20 shows a perspective view of the sixth embodiment magnetically engaged with a hexagonal cavity of a component. FIG. 21 shows a perspective view of a first alternate version of the sixth embodiment with a hexagonal prismatic magnetic pole piece in a relaxed state having an independent permanent magnet but without a magnet support base. FIG. 22 shows a perspective view of a second alternate version of the sixth embodiment in a relaxed state with a permanently magnetized head assembly having a hexagonal prismatic magnetic pole piece and FIG. 23 shows a perspective view of another representative example of the sixth embodiment with a cubic prismatic magnetic pole piece in a relaxed state including an independent permanent magnet.

The sixth embodiment includes the drive assembly 118 and a head assembly 196. The head assembly 196 includes a magnet 198, a body 197, with a base 200, and a prismatic magnetic pole piece 202 for engaging with a corresponding prismatic cavity. The body 197 serves to support the head assembly 196 and provides for attachment of the drive assembly 118 to the head assembly 196. The base 200 serves to provide support for the magnet 198. The prismatic magnetic pole piece 202 has side surfaces, each of which is represented by side surface 203. Many fasteners, plugs, bolts, nuts, screws and the like have a prismatic cavity or socket for engagement with a corresponding prismatic shape or post on a tool for application of torque for installation or removal. Transmissions and differentials on vehicles typically have an oil drain plug with a socket used for removal. As with oil in engines, oil in transmissions and differentials can be very hot during changing. The prismatic magnetic pole piece 202 can be inserted into a magnetic component 204 having a corresponding prismatic cavity. The side surfaces of the prismatic pole piece 202 and the corresponding side surfaces of the prismatic cavity in the magnetic component 204 have an internal angle between adjacent side surfaces approximately equal to $(1-2/n)\times180°$, where n is equal to the number of sides on the prismatic pole piece 202 and prismatic cavity. The magnet 198 provides the magnetic field which is coupled through and exits the base 200 for attracting and securing the magnetic component 204 to the head assembly 196, as shown in FIG. 20. The sixth embodiment has the same applications as the first embodiment for magnetic components having prismatic cavities used for installation and removal thereof.

Note that the prismatic magnetic pole piece 202 can have any prismatic shape and that the hexagonal prismatic shape is shown only as an example. Additionally, note that the prismatic magnetic pole piece 202 shown is solid but could be hollow with an open end. Also, note that the magnetic component 204 is shown as having an open end for clarity but also represents a prismatic cavity or socket with a closed end.

The sixth embodiment also includes a first alternate version having a head assembly 206 coupled to the drive assembly 118. The head assembly 206 includes a magnet 208, a body 207 and a prismatic magnetic pole piece 210. The head assembly 206 is essentially the same as the head assembly 196 with the base 200 eliminated.

In addition, the sixth embodiment includes a second alternate version having a head assembly 211 which includes a body 213 and a prismatic magnetic pole piece 212 coupled via the body 207 to the drive assembly 118, as shown in FIG. 22. The head assembly 211 can be either permanently magnetized or embedded with or coupled to a permanent magnet(s). The head assembly 211 is same as the head assembly 206 with the elimination of the external magnet 208 but retaining a magnetic field. Note that the prismatic magnetic pole piece 212 can have any prismatic shape and that the hexagonal prismatic shape is shown only as an example. Additionally, note that the magnetic pole piece 212 shown is solid but could be hollow with an open end.

Another representative example of the sixth embodiment is shown in FIG. 23. This version includes a head assembly 214 coupled to the drive assembly 118. The head assembly 214 includes a body 215, with a base 218, a prismatic magnetic pole piece 220 and a magnet 216. As with prismatic magnetic pole piece 202 and other hexagonal pole pieces of the sixth embodiment, prismatic magnetic pole piece 220 has side surfaces, each of which is represented by side surface 221. This version is the same as the other versions of the sixth embodiment with prismatic magnetic pole piece 220 being cubic rather than hexagonal.

The magnetic pole piece 202, magnetic pole piece 210 and magnetic pole piece 212, shown having a hexagonal prismatic shape, serve as only a representation of any prismatic shape, such as the cubic prismatic shape on magnetic pole piece 220, as shown in FIG. 23.

As another alternative, the modular arm assembly 168 can be installed on all versions of the sixth embodiment to hold the flexible shaft 128 in a pre-determined configuration, as with the third embodiment. As a further alternative, the drive assembly 118 can be eliminated and the head assemblies 196, 206, 211 and 214 finger manipulated independently or configured with a socket 142, as on the second embodiment, and used with a drive post on an installation tool, such as drivers 152 and 182. In an additional alternative, the drive assembly 118 can be eliminated and the head assemblies 196, 206, 211 and 214 finger manipulated and they can include a knurl 144 on their outside peripheries to enhance finger manipulation.

Operation of the Sixth Embodiment—FIG. 18, FIG. 20, FIG. 21, FIG. 22 and FIG. 23

The operation of the sixth embodiment is essentially the same as with the first, second and third embodiments, as applicable, with the prismatic magnetic pole pieces 202, 210, 212 and 220 inserted into the prismatic cavity of the magnetic component 204 until the outside end surface of the component 204 rests against the contact surface of the base 200, base 218 or base magnet 208. With respect to alternative sixth embodiment represented in FIG. 22, the pole piece 212 is inserted into the prismatic cavity until the inside end surface of the cavity contacts the pole piece 212. If the arm assembly 168 is included in the sixth embodiment, then the sixth embodiment is operated like the third embodiment with respect to configuring the drive assembly 118.

With respect to the alternatives of the sixth embodiment, the head assemblies 196, 206, 211 and 214 can be finger manipulated by contacting directly or with a tool inserted into the socket 142.

Seventh Embodiment

Figure 24:
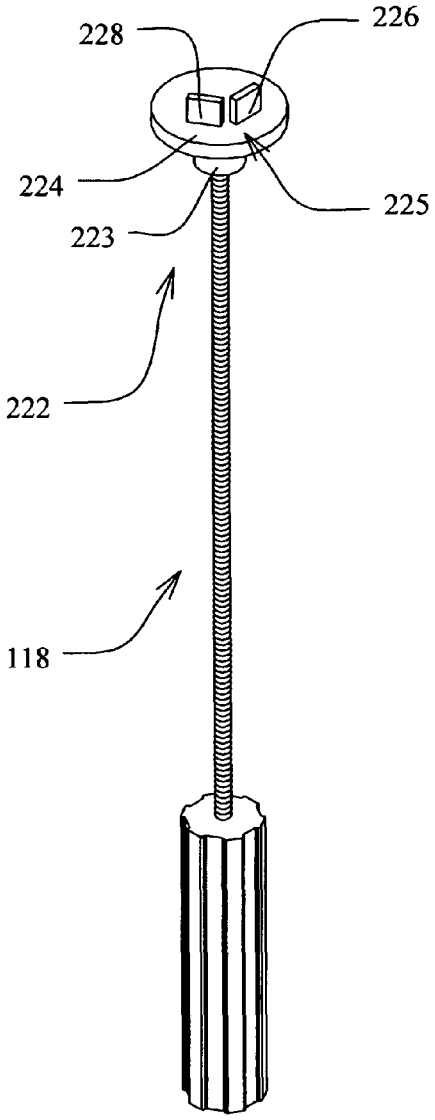
FIG. 24 is a perspective view showing a seventh embodiment in a relaxed state with a magnetic pole piece having two magnetic pole piece portions for engagement with a prismatic cavity of a component.
Figure 25:
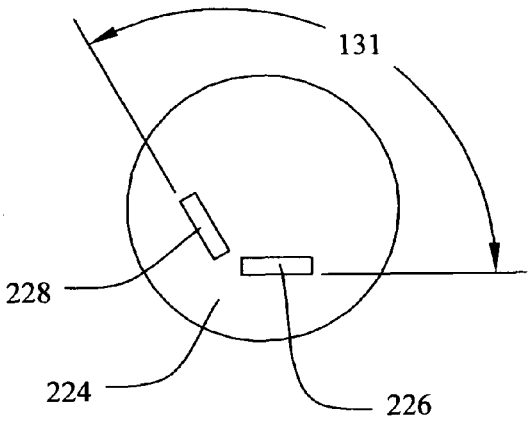
FIG. 25 is a top view of the seventh embodiment.
Figure 26:
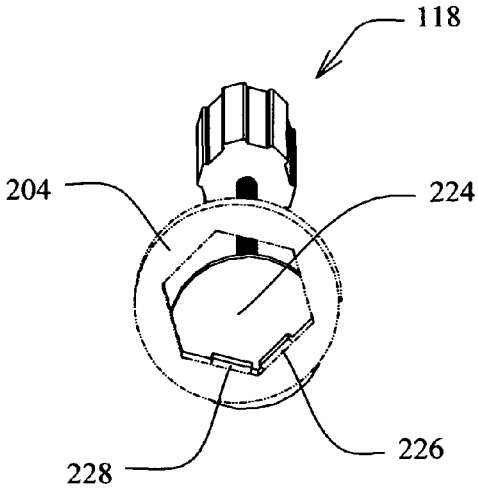
FIG. 26 is a perspective view showing the seventh embodiment magnetically engaged with a hexagonal cavity of a component.

FIG. 24, FIG. 25 and FIG. 26

Referring to FIG. 24, FIG. 25 and FIG. 26, a seventh embodiment is shown. FIG. 24 shows a perspective view of a seventh embodiment in a relaxed state with a magnetic pole piece having two magnetic pole piece portions for engagement with a prismatic cavity of a component. FIG. 25 shows a top view of the seventh embodiment and FIG. 26 shows a perspective view of the seventh embodiment magnetically engaged with a hexagonal cavity of a component.

The seventh embodiment includes the drive assembly 118 coupled to a head assembly 222. The head assembly 222 includes a body 223, with a base 224, and a magnetic pole piece 225. The head assembly 222 can be either permanently magnetized, have embedded permanent magnet(s) or further include magnet 198 or magnet 216 located as in the sixth embodiment. The magnetic pole piece 225 includes a magnetic pole piece portion 226 and a magnetic pole piece portion 228. The pole piece portion 226 and pole piece portion 228 are configured on the body 223 in a spaced relationship to each other, as shown in FIG. 25, in which their outer sides form the angle 131 of the first embodiment. The pole piece portion 226 and the pole piece portion 228 can be separated from each other (discontinuous), as shown, or joined (continuous). Note that the head assembly 222 is configured to be spatially open opposite from the magnetic pole piece 225. The pole piece portions 226 and 228 can have significantly varying sizes, shapes and surface areas with respect to each other, either with or without cutouts, and still perform adequately with respect to securing magnetic objects having prismatic shapes.

The seventh embodiment is configured for coupling to and engaging with a prismatic cavity of a component, such as the magnetic component 204, as shown in FIG. 26. The configuration of the seventh embodiment also permits coupling to and engaging with a prismatic shape applicable to the first embodiment in which the prismatic shape, such as the side surfaces of nut 132, contact the inner walls of the pole piece portions 226 and 228 instead of the outer walls as shown in FIG. 26.

As an alternative, the modular arm assembly 168 can be installed on the seventh embodiment to hold the flexible shaft 128 in a pre-determined configuration, as with the third embodiment. As another alternative, the drive assembly 118 can be eliminated and the head assembly 222 finger manipulated independently or configured with a socket 142, as on the second embodiment, and used with a drive post on an installation tool, such as drivers 152 and 182. In an additional alternative, the drive assembly 118 can be eliminated and the head assembly 222 finger manipulated and it can include a knurl 144 on its outside periphery to enhance finger manipulation.

Operation of the Seventh Embodiment—FIG. 26

The operation of the seventh embodiment is the same as with the first, second and third embodiments, as applicable, with the pole piece portions 226 and 228 inserted into the prismatic cavity of the component 204 until the outside end surface of the component 204 contacts the face contact surface of the base 224, as shown in FIG. 26. If the modular arm assembly 168 is included in the seventh embodiment, then the seventh embodiment is operated like the third embodiment with respect to configuring the drive assembly 118.

With respect to the alternatives of the seventh embodiment, the head assembly 222 can be finger manipulated by contacting directly.

Eighth Embodiment

Figure 27:
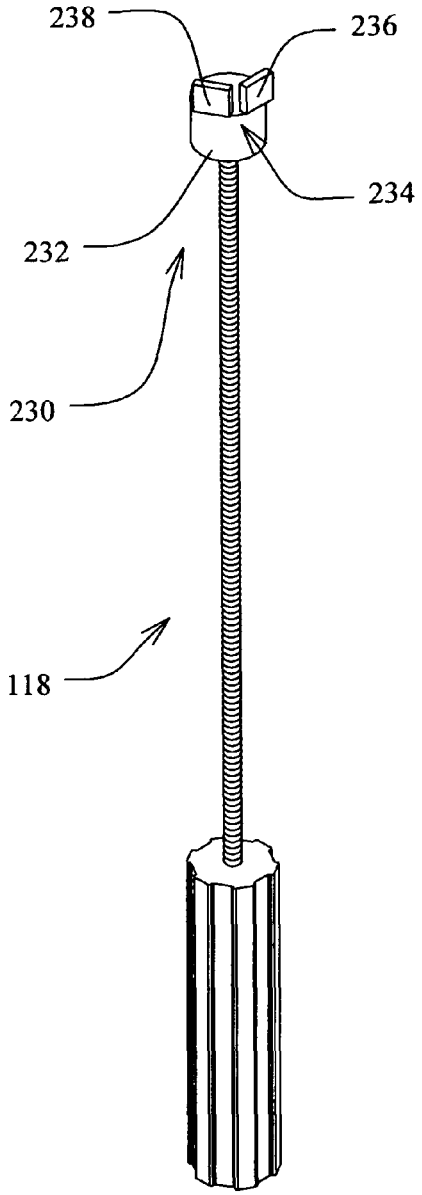
FIG. 27 is a perspective view showing an eighth embodiment in a relaxed state with a magnetic pole piece having two magnetic pole piece portions for engagement with a prismatic cavity of a component.
Figure 28:
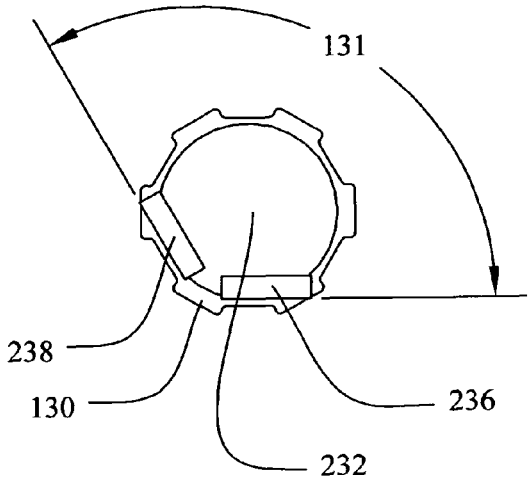
FIG. 28 is a top view of the eighth embodiment.
Figure 29:
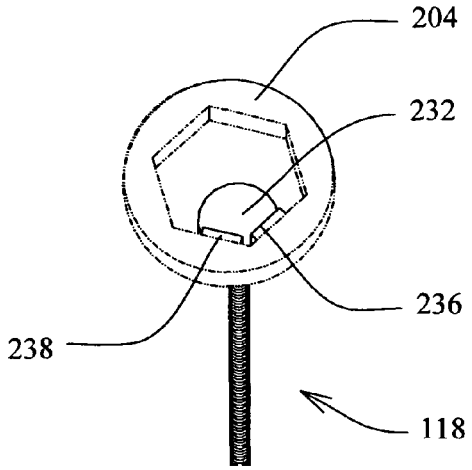
FIG. 29 is a perspective view showing the eighth embodiment magnetically engaged with a hexagonal cavity of a component.

FIG. 27, FIG. 28 and FIG. 29

Referring to FIG. 27, FIG. 28 and FIG. 29, an eighth embodiment is shown. FIG. 27 shows a perspective view of an eighth embodiment in a relaxed state with a magnetic pole piece having two magnetic pole piece portions for engagement with a prismatic cavity of a component. FIG. 28 shows a top view of the eighth embodiment and FIG. 29 shows a perspective view of the eighth embodiment magnetically engaged with a hexagonal cavity of a component.

The eighth embodiment includes the drive assembly 118 coupled to a head assembly 230. The head assembly 230 includes a body 232 and a magnetic pole piece 234. The head assembly 230 can be permanently magnetized or include an embedded or externally coupled permanent magnet(s). The magnetic pole piece 234 includes a magnetic pole piece portion 236 and a magnetic pole piece portion 238. The eighth embodiment is essentially the same as the seventh embodiment with the exception of the base 224 of the seventh embodiment being eliminated thereby, resulting in the capability of the head assembly 230 contacting the end inside surface of the cavity of the component 204. The pole piece portion 236 and the pole piece portion 238, with respect to each other, can be of dissimilar sizes, shapes and surface areas, either with and without cutouts, and still perform adequately with respect to securing magnetic objects having prismatic shapes. Note that the head assembly 230 is configured to be spatially open opposite from the magnetic pole piece 234.

As an alternative, the modular arm assembly 168 can be installed on the eighth embodiment to hold the flexible shaft 128 in a pre-determined configuration, as with the third embodiment. As another alternative, the drive assembly 118 can be eliminated and the head assembly 230 finger manipulated independently or configured with a socket 142, as on the second embodiment, and used with a drive post on an installation tool, such as drivers 152 and 182. In an additional alternative, the drive assembly 118 can be eliminated and the head assembly 230 finger manipulated and it can include a knurl 144 on its outside periphery to enhance finger manipulation.

Operation of the Eighth Embodiment—FIG. 29

The operation of the eighth embodiment is the same as the seventh embodiment with the exception that the pole piece 234 can be inserted until the head assembly 230 contacts the end surface of the respective cavity. If modular arm assembly 168 is included in the eighth embodiment, then the eighth embodiment is operated like the third embodiment with respect to configuring the drive assembly 118.

Ninth Embodiment

Figure 30:
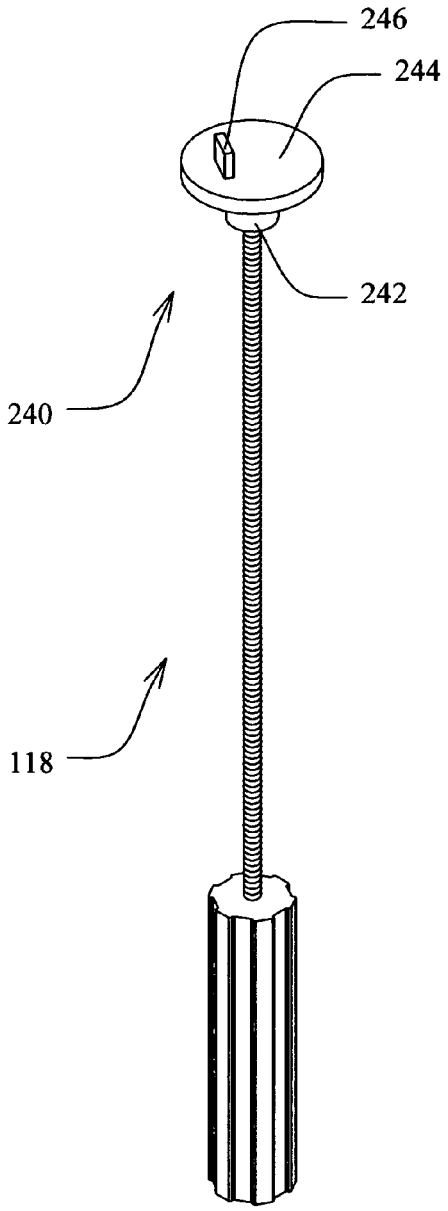
FIG. 30 is a perspective view showing a ninth embodiment in a relaxed state with a magnetic pole piece for engagement with a prismatic cavity of a component.
Figure 31:
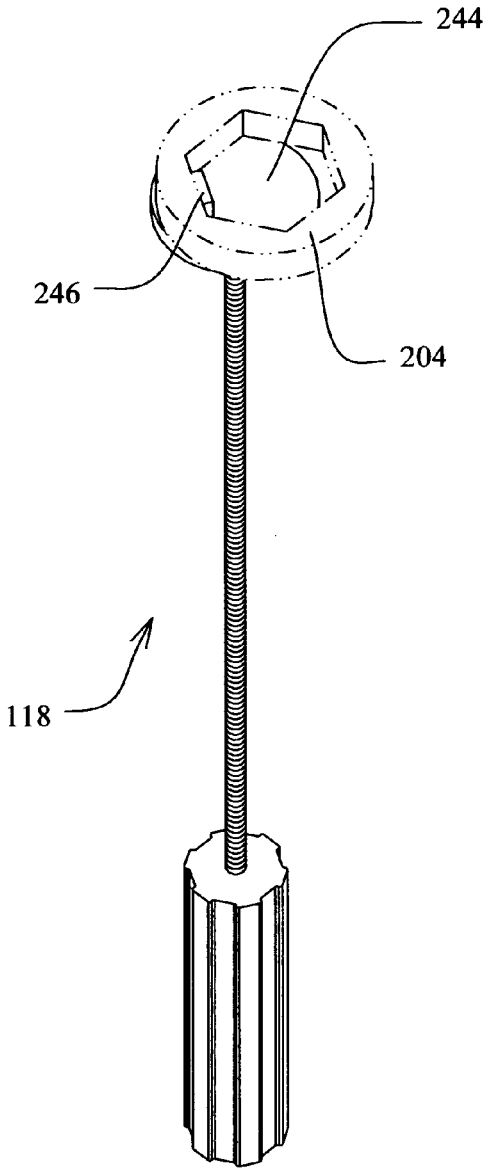
FIG. 31 is a perspective view showing the ninth embodiment magnetically engaged with a hexagonal cavity of a component.

FIG. 30 and FIG. 31

Referring to FIG. 30 and FIG. 31, a ninth embodiment is shown. FIG. 30 shows a perspective view of a ninth embodiment in a relaxed state with a magnetic pole piece for engagement with a prismatic cavity of a component and FIG. 31 shows a perspective view of the ninth embodiment magnetically engaged with a hexagonal cavity of a component.

The ninth embodiment includes the drive assembly 118 and a head assembly 240. The head assembly 240 includes a body 242, with a base 244, and a magnetic pole piece 246. The ninth embodiment is the same as the seventh embodiment with the elimination of one of the pole piece portions 226 and 228. The pole piece 246 can have a different size, shape and surface area, either with or without a cutout(s), from that shown.

As an alternative, the modular arm assembly 168 can be installed on the ninth embodiment to hold the flexible shaft 128 in a pre-determined configuration, as with the third embodiment. As another alternative, the drive assembly 118 can be eliminated and the head assembly 240 finger manipulated independently or configured with a socket 142, as on the second embodiment, and used with a drive post on an installation tool, such as drivers 152 and 182. In an additional alternative, the drive assembly 118 can be eliminated and the head assembly 240 finger manipulated and it can include a knurl 144 on its outside periphery to enhance finger manipulation.

Operation of the Ninth Embodiment—FIG. 31

The operation of the ninth embodiment is the same as the seventh embodiment except that only one side surface of the prismatic cavity in component 204 is engaged with pole piece 246, as shown in FIG. 31. If modular arm assembly 168 is included in the ninth embodiment, then the ninth embodiment is operated like the third embodiment with respect to configuring the drive assembly 118.

Tenth Embodiment

Figure 32:
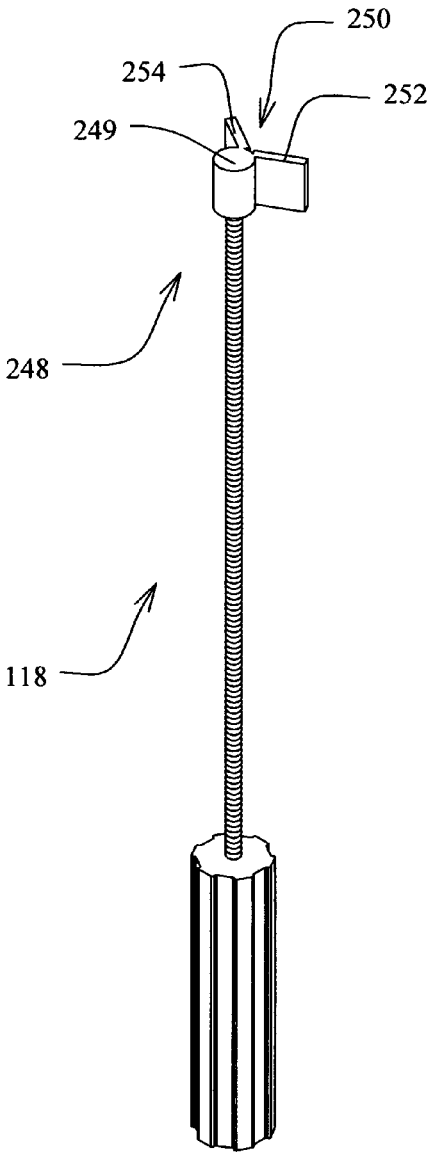
FIG. 32 is a perspective view showing a tenth embodiment in a relaxed state with a magnetic pole piece having two magnetized pole piece portions for engagement with a prismatic shape of a magnetic object.
Figure 33:
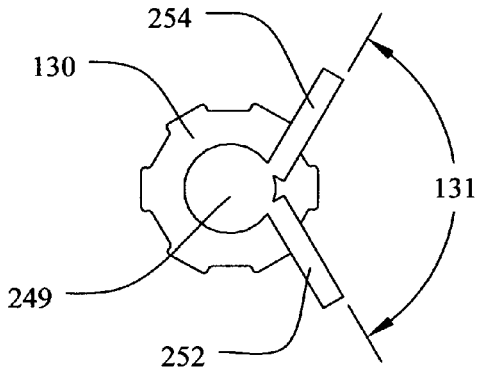
FIG. 33 is a top view of the tenth embodiment.
Figure 34:
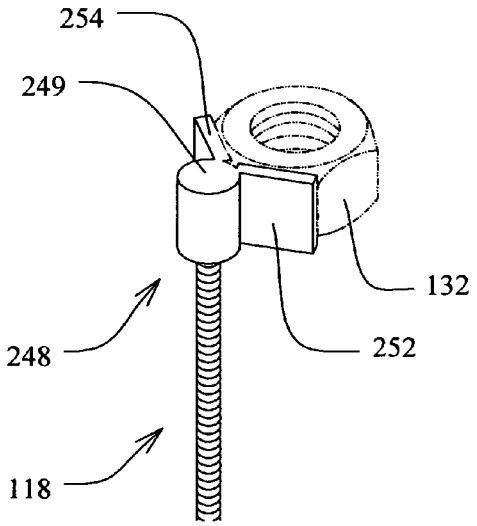
FIG. 34 is a perspective view showing the tenth embodiment magnetically engaged with a hex nut.

FIG. 32, FIG. 33 and FIG. 34

Referring to FIG. 32, FIG. 33 and FIG. 34, a tenth embodiment is shown. FIG. 32 shows a perspective view of a tenth embodiment in a relaxed state with a magnetic pole piece having two magnetic pole piece portions for engagement with a prismatic shape. FIG. 33 is shows a top view of the tenth embodiment and FIG. 34 shows a perspective view of the tenth embodiment magnetically engaged with a hex nut.

The tenth embodiment includes the drive assembly 118 and a head assembly 248. The head assembly 248 includes a body 249 and a magnetic pole piece 250. The magnetic pole piece 250 includes a magnetic pole piece portion 252 and a magnetic pole piece portion 254. The head assembly 248 can be either permanently magnetized or have embedded or externally coupled permanent magnet(s). The pole piece portion 252 and pole piece portion 254 are configured on the body 249 in a spaced relationship to each other, as shown in FIG. 33, in which their inner sides form angle 131 of the first embodiment. Note that the head assembly 248 is configured to be spatially open opposite from the magnetic pole piece 250. The pole piece portions 252 and 254 can have varying sizes, shapes and surface areas with respect to each other, either with or without cutouts and still perform adequately with respect to securing magnetic objects having prismatic shapes.

As an alternative, the modular arm assembly 168 can be installed on the tenth embodiment to hold the flexible shaft 128 in a pre-determined configuration, as with the third embodiment. As another alternative, the drive assembly 118 can be eliminated and the head assembly 248 finger manipulated independently or configured with a socket 142, as on the second embodiment, and used with a drive post on an installation tool, such as drivers 152 and 182. In an additional alternative, the drive assembly 118 can be eliminated and the head assembly 248 finger manipulated and it can include a knurl 144 on its outside periphery to enhance finger manipulation.

Operation of the Tenth Embodiment—FIG. 34

The operation of the tenth embodiment is the same as the first, second and third embodiments, as applicable, except that the end surface of the nut 132 or the end surface of the prismatic shape does not touch the head assembly 248, as with the first, second and third embodiments. If modular arm assembly 168 is included in the tenth embodiment, then the tenth embodiment is operated like the third embodiment with respect to configuring the drive assembly 118.

Eleventh Embodiment

Figure 35:
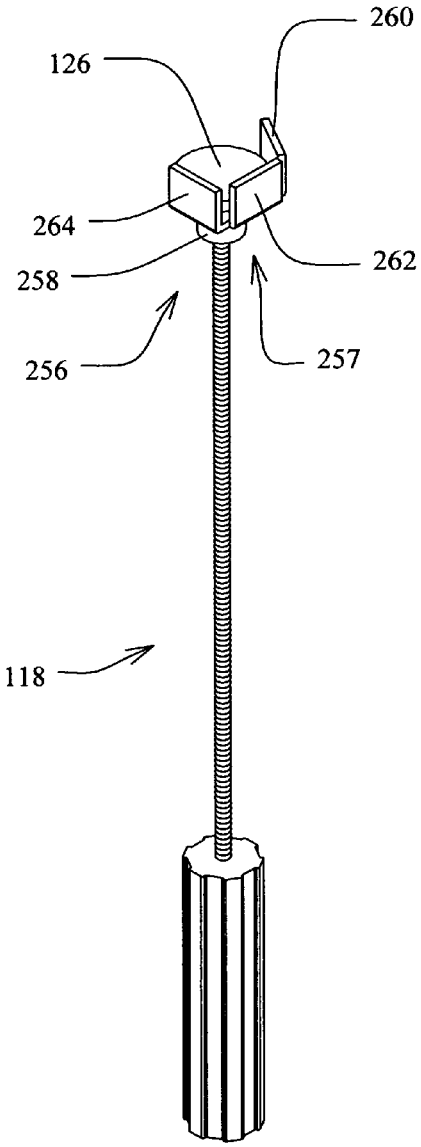
FIG. 35 is a perspective view showing the eleventh embodiment in a relaxed state including an independent permanent magnet and a magnetic pole piece having three magnetic pole piece portions.
Figure 36:
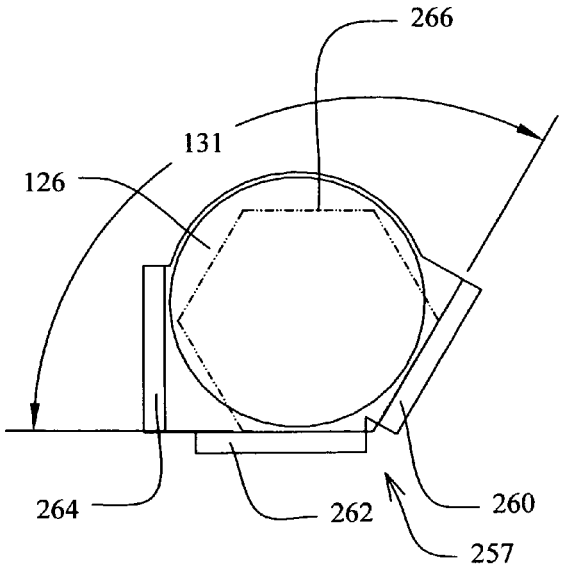
FIG. 36 is a top view of the eleventh embodiment showing a hexagonal prismatic shape of a magnetic object engaged with two of the three magnetic pole piece portions.
Figure 37:
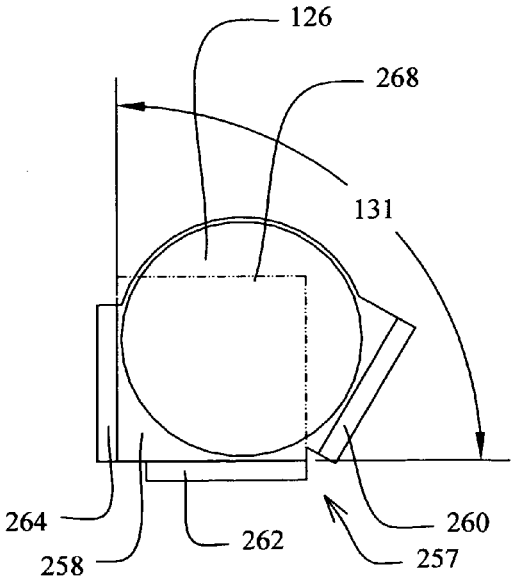
FIG. 37 is a top view of the eleventh embodiment showing a cubic prismatic shape of a magnetic object engaged with two of the three magnetic pole piece portions.

FIG. 35, FIG. 36 and FIG. 37

Referring to FIG. 35, FIG. 36 and FIG. 37, an eleventh embodiment is shown. FIG. 35 shows a perspective view of the eleventh embodiment in a relaxed state including an independent permanent magnet and a magnetic pole piece having three magnetic pole piece portions. FIG. 36 shows a top view of the eleventh embodiment with a hexagonal prismatic shape engaged with two of the three magnetic pole piece portions. FIG. 37 shows a top view of the eleventh embodiment with a cubic prismatic shape engaged with two of the three magnetic pole piece portions.

The eleventh embodiment includes the drive assembly 118 and a head assembly 256. The head assembly 256 includes a body 258, a magnetic pole piece 257 and the magnet 126. The magnet 126 is located on the body 258 as shown in FIG. 35. The magnetic pole piece 257 includes a magnetic pole piece portion 260, a magnetic pole piece portion 262 and a magnetic pole piece portion 264. The pole piece portion 260, the pole piece portion 262 and pole piece portion 264 are configured on the body 258 in a spaced relationship to each other, as shown in FIG. 35, FIG. 36 and FIG. 37. The pole piece portion 260 and pole piece portion 262 are in a spaced relationship forming the angle 131 between their inner surfaces and are used for engaging with a prismatic shape of a magnetic object having sides with a corresponding angle 131. Likewise, the pole piece portion 262 and pole piece portion 264 are in a spaced relationship forming a different angle 131 between their inner surfaces and are used for engaging with a prismatic shape of a magnetic object having sides with a corresponding angle 131.

FIG. 36 shows a hexagonal magnetic object 266 engaged with pole piece portions 260 and 262 and FIG. 37 shows a cubic magnetic object 268 engaged with pole piece portions 262 and 264. Note that the head assembly 256 is configured to be spatially open opposite from the magnetic pole piece 257. The pole piece portions 260, 262 and 264 can have varying sizes, shapes and surface areas with respect to each other, either with or without cutouts, and still perform adequately with respect to securing magnetic objects having prismatic shapes.

As an alternative to the eleventh embodiment, the magnet 126 can be eliminated and the head assembly 256 permanently magnetized. Additionally, the modular arm assembly 168 can be installed on the eleventh embodiment to hold the flexible shaft 128 in a pre-determined configuration, as with the third embodiment. As another alternative, the drive assembly 118 can be eliminated and the head assembly 256 configured with a socket 142, as on the second embodiment, for attachment with a drive post on an installation tool, such as drivers 152 and 182. In a further embodiment, the drive assembly 118 can be eliminated and the head assembly 256 finger manipulated and it can include a knurl 144 on its outside periphery to enhance finger manipulation.

Operation of the Eleventh Embodiment—FIG. 36 and FIG. 37

The operation of the eleventh embodiment is the same as the first, second and third embodiments, as applicable, with a prismatic shaped magnetic object, such as the hexagonal magnetic object 266 or the cubic magnetic object 268, engaged with the corresponding pole piece portions 260 and 262 or 262 and 264.

Twelfth Embodiment

Figure 38:
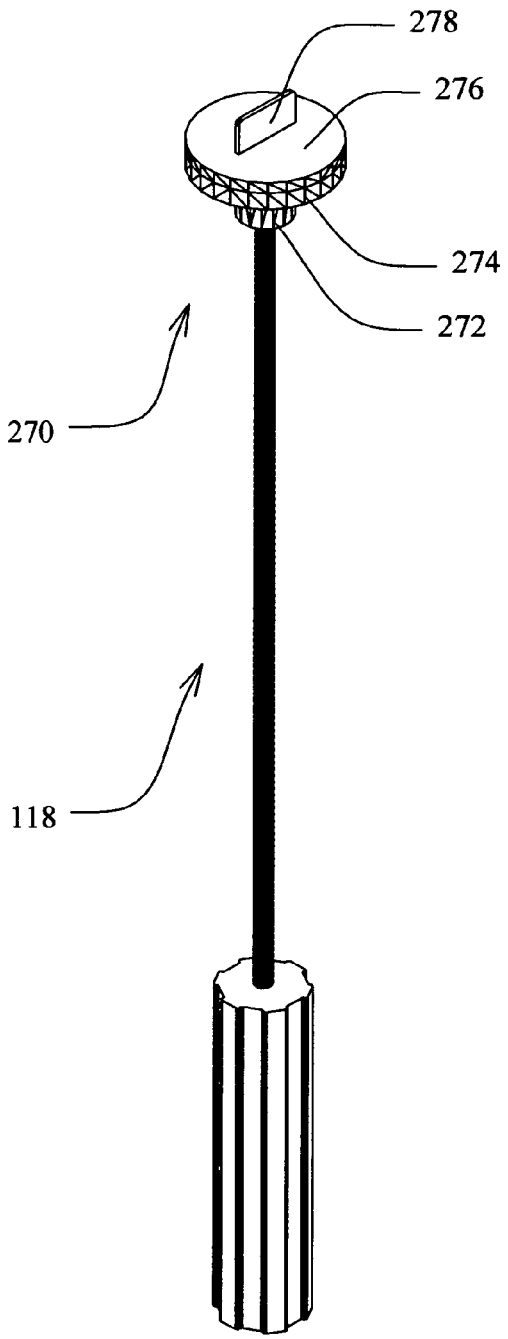
FIG. 38 is a perspective view showing a twelfth embodiment in a relaxed state with a magnetic pole piece for engagement with a prismatic cavity of a component.
Figure 39:
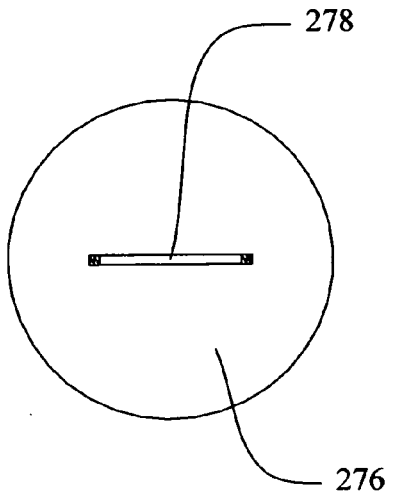
FIG. 39 is a top view of the twelfth embodiment.
Figure 40:
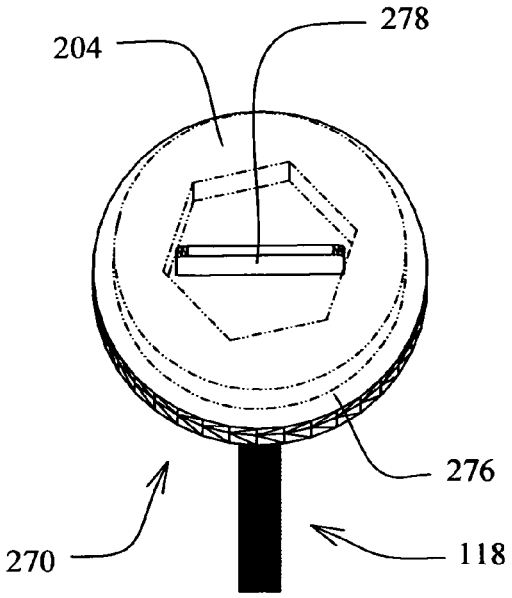
FIG. 40 is a perspective view showing the twelfth embodiment magnetically engaged with a hexagonal cavity of a component.

FIG. 38, FIG. 39 and FIG. 40

Referring to FIG. 38, FIG. 39 and FIG. 40, a twelfth embodiment is shown. FIG. 38 shows a perspective view of the twelfth embodiment in a relaxed state including an independent permanent magnet and a magnetic pole piece. FIG. 39 shows a top view of the twelfth embodiment. FIG. 40 shows a perspective view of the twelfth embodiment magnetically engaged with a hexagonal cavity of a component.

The twelfth embodiment includes the drive assembly 118 coupled to a head assembly 270. The head assembly 270 includes a body 272, a magnetic pole piece 278 and a magnet 274. The body 272 includes a base 276. The twelfth embodiment is configured for coupling to and engaging with two side surfaces of a prismatic cavity of a component, such as component 204, as shown in FIG. 40. The magnetic pole piece 278 engages with two side surfaces of the component 204 to provide torque to the component 204. The base 276 and magnet 274 secure the component 204 to the head assembly 270. The pole piece 278 can have a different size, configuration and/or surface area, either with or without a cutout(s), from that shown. The twelfth embodiment can also be used to provide torque to other components that have non-prismatic, non-circular cavities by contacting the sides or walls of the cavity at two locations.

As an alternative to the twelfth embodiment, the magnet 274 can be eliminated and the head assembly 270 permanently magnetized. Additionally, the modular arm assembly 168 can be installed on the twelfth embodiment to hold the flexible shaft 128 in a pre-determined configuration, as with the third embodiment. As another alternative, the drive assembly 118 can be eliminated and the head assembly 270 configured with a socket 142, as on the second embodiment, for attachment with a drive post on an installation tool, such as drivers 152 and 182. In a further embodiment, the drive assembly 118 can be eliminated and the head assembly 270 finger manipulated and it can include a knurl 144 on its outside periphery to enhance finger manipulation.

Operation of the Twelfth Embodiment—FIG. 40

The operation of the twelfth embodiment is the same as with the first, second and third embodiments, as applicable, with the pole piece 278 inserted into the prismatic cavity of the magnetic component 204 until the magnetic component 204 contacts the face contact surface of the base 276, as shown in FIG. 40. The magnetic field produced by the magnet 274 retains the component 204 to the head assembly 270. The ends of the magnetic pole piece 278 will contact the opposite inner side surfaces of the component 204 upon rotation of the head assembly 270 thereby permitting rotation of the component 204. If the modular arm assembly 168 is included in the twelfth embodiment, then the twelfth embodiment is operated like the third embodiment.

Thirteenth Embodiment

FIG. 4

The thirteenth embodiment defines a method of manipulating a magnetic object with at least a portion thereof having at least one of a substantially prismatic cavity and a substantially prismatic shape, each with side surfaces and an end surface, which includes the steps of: providing a device for manipulating the magnetic object, the device including the head assembly 116; positioning at least one of the side surfaces in contact with the magnetic pole piece 122 of the head assembly 116; retaining by magnetic attractive force, the magnetic object in position on the head assembly 116; manipulating the device to place, secure, fasten, install, and/or remove the magnetic object; and removing the magnetic object from the device. The head assembly 116 can be replaced with the head assemblies 138, 184, 196, 206, 211, 214, 222, 230, 240, 248, 256 or 270 and the magnetic pole piece 122 replaced with pole pieces 146, 190, 202, 210, 212, 220, 225, 234, 246, 250, 257 or 278, respectively as applicable.

Operation of the Thirteenth Embodiment

The operation of the Thirteenth embodiment is explained in the DETAILED DESCRIPTION OF THE EMBODIMENTS—Thirteenth Embodiment, above.

CONCLUSION, RAMIFICATIONS, AND SCOPE

A person of ordinary skill in the art will understand that the device and method for manipulating a magnetic object, with at least a portion thereof having a substantially prismatic shape or prismatic cavity is novel, simple, universal, as well as inexpensive and has many advantages, features and benefits over the prior art. Furthermore, it will be readily apparent to one skilled in the art that the device and method are essential for easy and effective remote placement, initial installation, and/or final removal of a magnetic object having a prismatic shape or cavity such as a fastener, bolt, nut, plug, screw, and the like in limited access locations. In addition, it should be evident that design of the head assemblies of the embodiments, which incorporate a magnetic pole piece to engage with at least one side of the prismatic shape or cavity, is truly unique. Moreover, the device and method may provide one or more of the additional advantages in that:

- the device permits remote placement, initial installation and/or final removal of both a magnetic object, having a substantial prismatic shape or cavity, and a washer, spacer or the like, simultaneously;
- the device permits remote placement, initial installation and/or final removal of magnetic objects, having a substantial prismatic shape or cavity, in off axis locations were device articulation is required;
- the device positively engages with all sizes of magnetic objects, having a substantial prismatic shape or cavity, without requiring the use of moving parts;
- the device permits remote placement, initial installation and/or final removal of magnetic objects, having a substantial prismatic shape or cavity, in adverse locations were pre-adjusted flexible shaft articulation is required to remain fixed;

the device permits the remote removal of drain plugs, having a substantial prismatic shape or cavity, while limiting the possibility of hot oil or other drained liquid from contacting the hands and/or arms; and the method defines a simple and effective process for remote placement, initial installation and/or final removal of magnetic objects, having a substantial prismatic shape or cavity, such as fasteners, bolts, nuts, plugs, screws and the like in distant and limited access locations.

Although the description above contains many specificities, these should not be construed as limiting the scope but as merely providing illustrations of some of the presently disclosed embodiments. Many other ramifications, variations, alterations, substitutions, modifications, and the like are enabled by the foregoing disclosure. For example, (1) sizes, shapes, materials, assembly, design, etc. of all parts can be readily modified or changed; (2) magnetic pole piece portions 123 and 124 can be configured to articulate about the body 120 to accommodate prismatic shapes with varying numbers of sides; (3) magnetic pole piece portions 147 and 148 can be configured to articulate about the body 140 to accommodate prismatic shapes with varying numbers of sides; (4) magnetic pole piece portions 226 and 228 can be configured to articulate about the head assembly 222 to accommodate prismatic shapes with varying numbers of sides; (5) magnetic pole piece portions 236 and 238 can be configured to articulate about the head assembly 230 to accommodate prismatic shapes with varying numbers of sides; (6) magnetic pole piece portions 252 and 254 can be configured to articulate about the body 223 to accommodate prismatic shapes with varying numbers of sides; (7) magnetic pole pieces 260, 262 and 264 can be configured to articulate about the body 258 to accommodate prismatic shapes with varying numbers of sides; (8) there can be more than two magnetic pole piece portions on magnetic pole pieces 122, 146, 225, 234, 250, such as on pole piece 257, to accommodate prismatic shapes with varying numbers of sides; (9) a buffer can be placed on head assemblies 116, 138, 184, 196, 206, 211, 214, 222, 230, 240, 248, 256 and 270 so that the end and/or sides of an attached prismatic shape does not actually contact these head assemblies; (10) the permanent magnets 126, 150, 198, 208, 216 and 274 can be replaced with an electromagnet, the handle 130 can be modified to incorporate a related electrical switch and to include a cavity for housing related batteries, and the flexible shaft 128 modified to accommodate related electrical wiring; (11) the head assemblies 116, 138, 184, 196, 206, 211, 214, 222, 230, 240, 248, 256 and 270 can include a light for illumination of the work area; (12) the permanent magnets 126, 150, 198, 208, 216 and 274 can be eliminated and their corresponding head assemblies permanently magnetized; (13) the magnets 126, 150, 198, 208, 216 and 274 can be integrated internally within the corresponding head assemblies 116, 138, 184, 196, 206, 214, 256 and 270; (14) the magnetic pole piece portions 123, 124, 147, 148, 226, 228, 236, 238, 252, 254, 260, 262 and 264 can be replaced with permanent magnets; (15) the magnetic pole pieces 190, 246 and 278 can be replaced with permanent magnets; (16) the magnetic pole piece portions 123, 124, 147, 148, 226, 228, 236, 238, 252, 254, 260, 262 and 264 can have a surface configuration other than a planar surface and/or can be split; (17) the magnetic pole pieces 190, 246 and 278 can have a surface configuration other than a planar surface and/or can be split; (18) The prismatic magnetic pole pieces 202, 210, 212 and 220 can have a cross section other than a regular polygon such as cross section configured as external or internal splines, a star, an ellipse, a non-regular polygon or a cross section with any geometrical configuration, (19) the adjustable arm assembly 168 can be of a design similar to that of the flexible zone of U.S. Pat. No. 3,409,224, issued Nov. 5, 1968 to Harry J. Harp, Walter T. Leible, and William M. McCort; and (20) the adjustable arm assembly 168 can be replaced with an adjustable arm assembly of any design and/or material that can withstand continuous flexing and twisting without degradation of the adjustable arm assembly's ability to retain a pre-configured curve.

Accordingly, the scope and meaning of the disclosed invention should be determined not by the embodiments illustrated or examples given, but by the appended claims and their legal equivalents.

I claim:

1. A device for manipulating a magnetic object with at least a portion thereof having a substantially non-magnetized prismatic cavity, the device comprising:

a head assembly, said head assembly including a body, a magnet and a substantially male configured prismatic magnetic pole piece; said pole piece having an upper end and a lower end; said body connects with said lower end and serving to support said prismatic pole piece; said magnet being positioned with respect to said pole piece at one of being embedded between said upper end and said lower end or below said lower end for attracting the prismatic cavity;

whereby, when said prismatic pole piece is placed in proximity to the prismatic cavity, the magnetic field produced by said magnet draws said pole piece into the prismatic cavity thereby allowing for the manipulation of the magnetic object.

2. The device as defined in claim 1 further including a flexible shaft and a handle, said flexible shaft having a first and a second end, said first end attached to and supporting said head assembly and said handle attached to and supporting said second end of said flexible shaft;

whereby, the magnetic object can be remotely manipulated by the device in areas of limited access.

3. The device as defined in claim 2 further including a semi-rigid adjustable arm assembly associated with said flexible shaft;

whereby, said flexible shaft can be maintained in a pre-configured state.

4. The device as defined in claim 1 wherein said magnetic field is produced by one of an independent permanent magnet and an electro-magnet.

5. The device as defined in claim 1 wherein said head assembly further includes a socket for removably engaging with a drive post.

6. A method for manipulating a magnetic object with at least a portion thereof having a substantially non-magnetized prismatic cavity, the method comprising the steps of: providing a device including a head assembly, said head assembly including a body, a magnet and a substantially male configured prismatic magnetic pole piece; said pole piece having an upper end and a lower end; said body connects with said lower end and serving to support said prismatic pole piece; said magnet being positioned with respect to said pole piece at one of being embedded between said upper end and said lower end or below said lower end for attraction to the prismatic cavity; positioning said pole piece in proximity to the prismatic cavity; retaining the magnetic object in position on said pole piece by magnetic attractive force; manipulating said device thereby manipulating the magnetic object and removing the magnetic object from said device.

7. The method as defined in claim 6 wherein said device further includes a flexible shaft and a handle, said flexible shaft having a first and a second end, said first end attached to and supporting said head assembly and said handle attached to and supporting said second end of said flexible shaft;

whereby, the magnetic object can be remotely manipulated by the device in areas of limited access.

8. The method as defined in claim 7 wherein said device further includes a semi-rigid adjustable arm assembly associated with said flexible shaft;

whereby, said flexible shaft can be maintained in a pre-configured state.

* * * * *